US011994028B2

(12) United States Patent
Newcombe et al.

(10) Patent No.: US 11,994,028 B2
(45) Date of Patent: *May 28, 2024

(54) MINING METHOD

(71) Applicant: NEWCREST MINING LIMITED, Melbourne (AU)

(72) Inventors: Geoff Newcombe, Melbourne (AU); Michael Sykes, Melbourne (AU); Pablo Paredes, Melbourne (AU); Luca Popa, Melbourne (AU)

(73) Assignee: NEWCREST MINING LIMITED, Melbourne (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/912,758

(22) PCT Filed: Mar. 19, 2021

(86) PCT No.: PCT/AU2021/050255

§ 371 (c)(1),
(2) Date: Sep. 19, 2022

(87) PCT Pub. No.: WO2021/184081

PCT Pub. Date: Sep. 23, 2021

(65) Prior Publication Data

US 2023/0134275 A1 May 4, 2023

(30) Foreign Application Priority Data

Mar. 19, 2020 (AU) ..... 2020900842

(51) Int. Cl.
*E21C 41/16* (2006.01)
*E21C 41/22* (2006.01)
*F42D 3/04* (2006.01)

(52) U.S. Cl.
CPC ..... *E21C 41/22* (2013.01); *F42D 3/04* (2013.01)

(58) Field of Classification Search
CPC . E21C 41/22; E21C 41/16; F42D 3/04; E21B 7/04; E21B 43/26
See application file for complete search history.

(56) References Cited

U.S. PATENT DOCUMENTS 3,897,107 A 7/1975 Haglund
11,125,084 B1 * 9/2021 Sykes ..... E21C 41/22
(Continued)

FOREIGN PATENT DOCUMENTS

WO 2013163773 A1 9/2013

OTHER PUBLICATIONS

International Search Report and Written Opinion, dated Apr. 20, 2021, pertaining to International Patent Application PCT/AU2021/050255, 12 pages.

(Continued)

*Primary Examiner* — Michael D David
(74) *Attorney, Agent, or Firm* — Dinsmore & Shohl LLP

(57) ABSTRACT

A block cave has a draw column height of at least 450 m, a caved volume, a single extraction level and noundercut level, a plurality of drawbells extending upwardly from the extraction level to the caved volume, and a plurality of pillars separating the drawbells and supporting the rock mass above the extraction level. Each drawbell has a drawbell height of at least 25 m. Each drawbell has the following profile when viewed from a direction perpendicular to a drawbell drive in the extraction level: a throat section having opposed parallel side walls extending upwardly from the extraction level, a tapered section above the throat section, and an undercut section above the tapered section.

10 Claims, 13 Drawing Sheets

(56) References Cited

U.S. PATENT DOCUMENTS

| | | | | |
|---|---|---|---|---|
| 2011/0006774 | A1* | 1/2011 | Baiden | G01S 5/10 324/334 |
| 2012/0242135 | A1* | 9/2012 | Thomson | F42D 1/055 299/13 |
| 2013/0106165 | A1 | 5/2013 | Oddie et al. | |
| 2013/0140872 | A1* | 6/2013 | Jeffrey | E21C 37/12 299/20 |
| 2014/0286738 | A1 | 9/2014 | Zimmerman et al. | |
| 2015/0019133 | A1* | 1/2015 | Davis | G01S 15/89 702/2 |
| 2016/0245083 | A1* | 8/2016 | Rubie | E21F 13/025 |
| 2017/0067341 | A1* | 3/2017 | Baiden | B25J 11/00 |
| 2019/0353186 | A1* | 11/2019 | Redfern | F42D 1/10 |
| 2023/0203946 | A1* | 6/2023 | Wagner | E21C 41/22 299/1.05 |
| 2023/0228193 | A1* | 7/2023 | Wagner | E21C 41/22 299/19 |

OTHER PUBLICATIONS

Newcrest Briefing Book,Feb. 2020. (online) Newcrest Mining Limited Feb. 24, 2020 <http://www.aspecthuntley.com.au/asxdata/20200224/pdf/02205957.pdf> Complete Document, 77 pages.

Malovichko, "Analysis of damaging seismic event on Dec. 24, 2011 in the Pilar Norte sector of El Teniente mine", Caving, pp. 637-650, 2018.

Panel Caving Experiences and Macrotrench (Macrozanja)—An Alternative Exploitation Method at the El Teniente Mine, Codelco, Chile 1999.

* cited by examiner

MINING METHOD

CROSS REFERENCES TO RELATED APPLICATIONS

This application is a national-stage application under 35 U.S.C. § 371 of International Application No. PCT/AU2021/050255, filed Mar. 19, 2021, which International Application claims benefit of priority to Australian Patent Application No. 2020900842, filed Mar. 19, 2020.

FIELD OF THE INVENTION

The present invention relates to block caves and block cave mining methods for removing ore containing valuable metal from a mine.

BACKGROUND OF THE INVENTION

Block cave mining is an efficient technique that leverages gravity and induced stress to support the efficient extraction of ore from an ore body.

Cave mining methods, due to their low cost and high productivity, have historically been the preferred underground solution to profitably mine large, low-grade deposits.

However, the cave mining industry has entered a less certain environment where some of the cave mining options are already showing not to be fully suitable to achieving the envisaged low cost and high productivity. This environment comprises deeper and blind deposits (>1,400 m from the surface), lower grade, harder and heterogeneous rock masses, and higher in-situ rock stress regimes.

A major drawback of block caving is the high upfront capital cost and long lead time required to establish name plate production rates. Total lateral development to establish a new cave including access can be as much as 150 km and take up to 7 years, with capital costs ranging in the order of US$2 billion to US$5 billion. Establishment time and cost is exacerbated by increasingly complex ore bodies at depth, including depth related issues such as low grades, strength/stress ratios, material handling costs, heat, etc.

For ore bodies of the future to be extracted safely and economically via block caving, step changes in mining strategies, techniques and processes are required. Developing a new cave establishment method is one of the strategies on that path.

The present invention is concerned with enabling quicker development of block caves and improving the overall capital and productivity efficiency of block caves.

Conventional block caves are established from two levels: an undercut level which functions to facilitate the creation of a void above a draw horizon to induce the caving process, and a draw horizon (extraction or production) level where the drawbells are opened and connected to the undercut level, allowing caved ore to be extracted via the drawbells.

In this context, undercutting is a process whereby a slice of the ore body (typically 5 to 20 m high) is mined using various drill and blast techniques. Depending on the order in which undercutting is performed (prior to or after opening the drawbell), the undercutting methods are classified as: advanced undercut, pre-undercut and post undercut. In the advanced and pre-undercut environments, the broken material from undercut blasting is removed through the undercut level; while in the post undercutting environment the blasted material is removed directly from the already established drawbells on the extraction or production level—see FIG. 1.

The common factor among current undercutting methodologies is a requirement for the development of the undercut level and in some cases two undercut levels, in addition to the extraction or production level, which has time and cost implications. The applicant has found that for an advanced undercut method including an apex level, the development of the undercut can be up to 45% of the total footprint development metres. Furthermore, undercutting activities take place in the abutment zone of a block cave and expose people and equipment to high stress areas and risk from seismic responses to mining.

There have been proposals for an undercutless cave establishment, i.e. a single pass cave establishment (also referred to as "SPCE"), method in which drawbell opening and undercutting are performed simultaneously from an extraction or production level, without the need for a dedicated undercut level.

When compared with the conventional undercut methods, a single pass cave establishment method can:

Improve safety by removing the exposure of personnel to activities traditionally completed in the undercut level, with activities completed distant from the high stress zones;

Reduce cave establishment time;

Reduce direct footprint capital cost;

Be more amenable to automation and remote operation than traditional caving methods;

Improve sustainability by reducing cost increasing deposit recovery.

To date, published information in the mining industry on undercutting from the extraction level is limited to El Teniente's "high drawbell" method and the "no-undercut" method trial carried out at the Henderson Mine.

The El Teniente mine has used the "high drawbell" method to open drawbells from the extraction level to connect through the major and minor apex and undercut the ore body, without drilling and blasting from the pre-existing undercut level. The high drawbell method evolved as a contingency method to recover collapsed levels in 1991 and has since been used as a recovery alternative for areas with high geotechnical risks and collapse issues. This option has not been designed specifically as a primary undercutting method for new expansions, but as an adaptation of other methods to solve particular issues.

The scope of the "no-undercut" trial conducted at Henderson Mine was to develop a drill and blast method that could open drawbells and achieve complete undercutting from an extraction level in a single blast event. The trial was carried out in a section of the mine having an extraction level and an undercut level. The existing undercut drives in the undercut level ensured connectivity between drawbells and, at the same time, offered an ideal observation point from which blast results could be assessed. Although the Henderson trial was considered successful, no further work was undertaken towards its implementation.

Fundamentally, the El Teniente and Henderson methods are similar in that both methods open drawbells and undercut an ore body from an extraction level, and in both cases the existing undercut drives in the undercut level above the extraction level ensured complete connection between adjacent initial drawbells.

However, there is no certainty that these methods can be extensively applied in new ore bodies or expansions of these without an existing undercut level.

For example, the established drawbell and pillar geometries at the El Teniente (Chile) and Henderson (USA) mines are significantly smaller than the geometries at the Cadia East mine of the applicant and the El Teniente and Henderson methods are not directly transferrable to the Cadia East mine and other mines.

| Concept | Unit | El Teniente 'High Drawbell' | Henderson 'no-undercut' test |
|---|---|---|---|
| Distance between undercut level (UCL) and extraction level (EXL) | m | 18 | 18 |
| Drawbell and undercut height (from EXL floor) | m | 22 | 29 |
| Distance between extraction drives | m | 30 | 31 |
| Distance between drawbell drives | m | 20 | 17 |

The present invention provides a new concept for block caves.

The above description and the description below in relation to conventional two-level block caves shown in FIGS. 1A, 1B, and 1C is not an admission of the common general knowledge in Australia or elsewhere.

SUMMARY OF THE INVENTION

The applicant has developed a new concept for block caves that makes it possible to form and operate block caves that have high draw column heights, i.e. draw columns of at least 450 m, with reduced establishment time and capital cost than conventional block caves and establish strong, long lasting, drawbells and pillars that are required in deep caving environments.

The term "draw column height" understood to mean the height of a rock mass that can be drawn from a block cave via an extraction level.

In a conventional block cave, the draw column height is measured from the floor of the undercut level.

In the case of a block cave of the invention, i.e. a block cave having a single extraction level and no undercut level, the draw column height is measured from the major apices of the pillars. This measurement start point is where an undercut drive floor would be in a conventional post undercut layout of the type shown in FIGS. 1A, 1B, and 1C.

Key enablers for the concept include any one or more of:

(a) a block cave with a single extraction level and no undercut level (i.e. undercutless), i.e. a block cave formed by a single pass cave establishment method;

(b) pre-conditioning a rock mass above the extraction level by fracturing the rock mass via pre-conditioning actions initiated from a mine surface or an upper level of the block cave above the extraction level and thereby assisting subsequent removal of the rock mass via the extraction level; and (c) technology to move fractured rock mass from the drawbells on the extraction level to the surface for processing at the surface.

The present disclosure focuses on the undercutless enabler (a), although there is some description of the preconditioning enabler (b).

The undercutless enabler (a) comprises:

1. Block cave per se.
2. Drawbell profile.
3. Method of drilling and blasting drawbells.
4. Method of establishing a block cave.

Items 1-4 are discussed further below.

The claims focus on a combination of items 1 and 2.

The combination of items 1 and 2 is a block cave that has a draw column height of at least 450 m, a caved volume, a single extraction level and no undercut level, a plurality of drawbells extending upwardly from the extraction level to the caved volume, and a plurality of pillars separating the drawbells and supporting the rock mass above the extraction level. Each drawbell has a drawbell height of at least 25 m. Each drawbell has the following profile when viewed from a direction perpendicular to a drawbell drive in the extraction level: a throat section having opposed parallel side walls extending upwardly from the extraction level, a tapered section above the throat section, and an undercut section above the tapered section.

More particularly, a block cave has a draw column height of at least 450 m and comprises:

(a) a caved volume of caved rocks within a rock mass, (b) a single extraction level and no undercut level, with the extraction level including a layout of a plurality of parallel drawbell drives and a plurality of parallel extraction drives that define passages for removing rocks from the caved volume, with the extraction drives intersecting the drawbell drives;

(c) a plurality of drawbells extending upwardly from the drawbell drives and interconnecting the drawbell drives and the caved volume, each drawbell defining a volume through which rocks can move downwardly from the caved volume to one of the drawbell drives, wherein each drawbell has:

i. a drawbell height of at least 25 m measured from a back of the extraction level (which may be described as a roof in other industries) to a highest point of the drawbell, and ii. the following profile in a direction of a drawbell drive in the extraction level, i.e. when viewed in a direction perpendicular to the direction of the drawbell drive:

a. a throat section having opposed parallel side walls extending upwardly, typically perpendicular, from the extraction level, b. a tapered section above the throat section, the tapered section having side walls extending outwardly from upper ends of the side walls of the throat section, and c. an undercut section above the tapered section, the undercut section having opposed parallel side walls extending upwardly from upper ends of the side walls of the tapered section and typically perpendicular to the extraction level; and (d) a plurality of pillars separating the drawbells and supporting the rock mass above the extraction level.

It is noted that the drawbell volume of each drawbell is formed as a void, i.e. empty volume, by blasting rock and form the drawbell, and the empty volume is quickly filled by rocks from the caved volume after block cave mining commences, with caved rocks moving downwardly and filling the empty volume and being removed from the drawbell drive by excavator and haulage vehicles or other suitable vehicles and transported from the extraction level for further processing to recover valuable metals form the rocks.

1. Block Cave

As noted above, the applicant has invented a new concept for block caves that makes it possible to form and operate block caves that have high draw columns, i.e. draw columns of at least 450 m.

In broad terms, a block cave that has a draw column height of at least 450 m and comprises:

(a) a caved volume of caved rocks within a rock mass, (b) a single extraction level and no undercut level, with the extraction level including a layout of a plurality of drawbell drives and a plurality of extraction drives that define passages for removing rocks from the caved volume, with the extraction drives intersecting the drawbell drives;

(c) a plurality of drawbells extending upwardly from the drawbell drives and interconnecting the drawbell drives and the caved volume, each drawbell defining a volume through which rocks can move downwardly from the caved volume to one of the drawbell drives, and (d) a plurality of pillars separating the drawbells and supporting the rock mass above the extraction level.

The extraction level layout may be any suitable layout of parallel extraction drives and parallel drawbell drives.

By way of example, the layout may be any one or more of the layouts known as an El Teniente layout, a Herringbone layout, or a Henderson layout or any other suitable layout.

It is noted that the invention is equally applicable to these and other layouts and the skilled person will understand the variations in dimensions that may be required having regard to differences in the layouts. Having said this, the basic combinations of features of the block cave of the invention remain the same across the layouts.

The block cave may comprise any suitable number of drawbells.

Typically, the block cave comprises at least 75 drawbells.

More typically, the block cave comprises at least 100 drawbells.

The block cave may comprise at least 125 drawbells.

Each drawbell may have an upper opening for rocks from the caved volume.

The following description is in the context of an El Teniente layout having straight parallel extraction drives and straight parallel drawbell drives that are transverse to the extraction drives at an angle of approximately 60°.

The drawbell drives may be at an angle of at least 30° to the extraction drives.

The drawbell drives may be at an angle of at least 45° to the extraction drives.

The drawbell drives may be at an angle of at least 55° to the extraction drives.

The drawbell drives may be at an angle of up to 90° to the extraction drives.

The draw column height may be at least 500 m.

The draw column height be at least 600 m.

The draw column height may be at least 700 m.

The draw column height may be at least 800 m.

The drawbells and the pillars may have any suitable profile.

The applicant has identified the following key design drivers for the block cave:

(a) extraction drive spacing;

(b) drawbell drive spacing;

(c) drawbell height; and (d) the height of an undercut section of the drawbell, as described herein.

The term "undercut section of the drawbell" is understood herein to mean a consistent void across the drawbell above a position where an undercut drive floor would be in a conventional post-undercut layout of the type shown in FIGS. 1A, 1B, and 1C.

It is noted that the above-described drawbell comprises (a) an upper component in the form of the undercut section and (b) a lower component.

It is noted that the invention is not confined to these design drivers and extends to any suitable combination of drivers.

The spacing between adjacent extraction drives may be at least 34 m, measured between the centre of each extraction drive.

The spacing between adjacent extraction drives may be at least 35 m, measured between the centre of each extraction drive.

In some embodiments, the spacing between adjacent extraction drives may be up to 50 m, measured between the centre of each extraction drive.

The spacing between adjacent drawbell drives may be at least 20 m, measured between the centre of each extraction drive.

The spacing between adjacent drawbell drives may be at least 24 m, measured between the centre of each extraction drive.

The spacing between adjacent drawbell drives may be at least 25 m, measured between the centre of each extraction drive.

In some embodiments, the spacing between adjacent drawbell drives may be up to 40 m, measured between the centre of each extraction drive.

The drawbells may have a drawbell height of at least 30 m measured from a back (which, as noted above, may be described as a roof in other industries) of the extraction level to a highest point of the drawbell.

The drawbells may have a drawbell height of at least 33 m measured from the back of the extraction level to the highest point of the drawbell.

The drawbell height may be at least 40 m measured from the back of the extraction level to the highest point of the drawbell.

The drawbell height may be at least 45 m measured from the back of the extraction level to the highest point of the drawbell.

The drawbell height may be 30-50 m measured from the back of the extraction level to the highest point of the drawbell.

In some embodiments, the drawbell height may be up to 50 m measured from the back of the extraction level to the highest point of the drawbell.

The height of the undercut section of the drawbell may be at least 7 m.

The undercut height may be at least 10 m.

In some embodiments, the undercut height may be up to 20 m.

Other features of the drawbells, including drawbell profile, may be as defined in invention 2—see below.

The pillars that separate the drawbells may terminate in an apex section at a maximum height of the pillars, with the apex section defining a boundary of each drawbell.

The apex section may be narrow rock ridges at the maximum height of the pillars.

The narrow rock ridges of each drawbell may be quadrilateral with one pair of parallel longer rock ridges and another pair of shorter parallel rock ridges.

Each drawbell may be formed so that (a) each longer rock ridge is spaced above and mid-way between two adjacent drawbell drives and (b) each shorter rock ridge is spaced above a centreline of an extraction drive. This is a "regular" layout.

Alternatively, each drawbell may be formed so that (a) each longer rock ridge is spaced above and mid-way between two adjacent drawbell drives and (b) each shorter rock ridge is spaced above and extends transverse to an extraction drive. This is a "staggered" layout.

Each pillar may have the following profile in a direction of the drawbell drive in the extraction level, i.e. when viewed in a direction perpendicular to the direction of the drawbell drive:

(a) a base section having opposed parallel side walls extending upwardly, typically perpendicular, to the extraction level (which is typically horizontal), and (b) an upper tapered section having side walls extending inwardly towards each other from upper ends of the side walls of the base section and terminating in the apex section.

It is noted that the side walls of the pillar described in the preceding paragraph define sides of drawbells.

The maximum height of the pillar, often referred to as a major pillar height, may be at least 20 m, typically at least 24 m, more typically at least 26 m, and more typically again at least 27.5 m, as measured form a floor of the extraction level.

The height of the base section of the pillar, often referred to as the brow height, may be at least 10 m as measured from a back of the extraction level.

The spacing of the side walls of the base section of the pillar, often referred to as the major pillar width, may be at least 26 m.

The side walls of the tapered section of the pillar may be at an outward drawbell slope angle of at least 40°, typically at least 50°, and more typically at least 60° to the extraction level, which is typically horizontal.

The side walls of the tapered section of the pillar may be at an outward drawbell slope angle of 40-70° to the plane of the extraction level.

2. Drawbell Profile Invention

The applicant has recognised that a single pass cave establishment block cave of invention 1, i.e. a block cave having a single extraction level and no undercut level with high draw column heights of at least 450 m, requires increasing the heights and general dimensions of drawbells beyond current industry experience in undercutless block caving, such as the above-described the El Teniente and Henderson methods.

The applicant has invented a particular drawbell profile that makes this possible.

It is noted that the block cave of invention 1 is not confined to the following drawbell profile.

In broad terms, another invention provides a drawbell defining a volume extending between and interconnecting a caved volume and an extraction level of a block cave, so that in a mining operation caved rocks can flow downwardly from the caved volume to the extraction level, whereby the drawbell has:

(a) a drawbell height of at least 25 m measured from a back of the extraction level to a highest point of the drawbell, and (b) the following profile in a direction of a drawbell drive in the extraction level, i.e. when viewed in a direction perpendicular to the direction of the drawbell drive:

i. a throat section having opposed parallel side walls extending upwardly, typically perpendicular, from the extraction level, ii. a tapered section above the throat section, the tapered section having side walls extending outwardly from upper ends of the side walls of the throat section, and iii. an undercut section above the tapered section, the undercut section having opposed parallel side walls extending upwardly from upper ends of the side walls of the tapered section and typically perpendicular to the extraction level.

The throat, tapered and undercut sections of the profile of the drawbell may also include a front wall and a rear wall extending upwardly and outwardly in relation to each other from the extraction level.

The drawbell void volume may be at least 9,000 $m^3$, typically at least 10,000 $m^3$, and more typically at least 12,000 $m^3$.

It is noted that the above-described drawbell comprises (a) an upper region in the form of the undercut section and (b) a lower region in the form of the throat and the tapered sections.

The applicant has identified the following key design drivers for the drawbell profile of the invention:

(a) drawbell height;

(b) undercut height; and (c) drawbell width, which is related to extraction drive spacing; and (d) drawbell length, which is related to drawbell drive spacing.

It is noted that the invention is not confined to these drivers and extends to any suitable combination of drivers.

The drawbell height may be at least 30 m measured from a back (which may be described as a roof in other industries) of the extraction level to the highest point of the drawbell.

The drawbell height may be at least 33 m measured from the back of the extraction level to the highest point of the drawbell.

The drawbell height may be at least 40 m measured from the back of the extraction level to the highest point of the drawbell.

The drawbell height may be at least 45 m measured from the back of the extraction level to the highest point of the drawbell.

The drawbell height may be 30-50 m measured from the back of the extraction level to the highest point of the drawbell.

In some embodiments, the drawbell height may be up to 50 m measured from the back of the extraction level to the highest point of the drawbell.

A major function of the undercut section is to interconnect adjacent drawbells in the direction of the drawbell drives and adjacent drawbells in the direction of the extraction drives.

The undercut section may have a curved upper wall.

The height of the throat section of the drawbell, often referred to as the brow height, may be at least 10 m.

The height of the tapered section of the drawbell may be at least 16 m. It is noted that typically this height is a result of the brow height, the pillar height, and the slope angle.

The height of the undercut section of the drawbell may be at least 7 m.

The undercut height may be at least 10 m.

In some embodiments, the undercut height may be up to 20 m.

The spacing between the side walls of the throat section of the drawbell, i.e. the drawbell throat length, may be at least 14 m.

The spacing between the side walls of the undercut section of the drawbell, i.e. the total drawbell length (which comprises the total of the drawbell throat length and the drawbell apron lengths on opposite sides of the drawbell throat), may be at least 40 m.

The side walls of the throat section of the drawbell may be at an outward drawbell slope angle of at least 70°, typically at least 80° to a plane of the extraction level, i.e. the horizontal.

The side walls of the tapered section of the drawbell may be at an outward drawbell slope angle of at least 40°, typically at least 50°, and more typically at least 60° to a plane of the extraction level, i.e. the horizontal.

The side walls of the tapered section of the drawbell may be at an outward drawbell slope angle of 40-70° to the plane of the extraction level.

In addition, the drawbell may have a tapered profile extending upwardly and outwardly from the extraction level in a direction that is transverse to the drawbell drive. The outwardly tapered profile facilitates interconnecting successive drawbells across drawbell drives at the level of the undercut sections of the drawbells.

Typically, when the drawbell described above is a part of the block cave of invention 1, the spacings of the drawbell drives and the extraction drives will be based on the dimensions of the drawbell.

Each drawbell may have an upper opening for rocks from the caved volume to flow downwardly through the drawbell to the drawbell drives in the extraction level.

Each drawbell may be defined by rock mass pillars that support the rock mass above the drawbells.

The pillars that separate the drawbells may terminate in an apex section at a maximum height of the pillars, with the apex section defining a boundary of each drawbell.

The apex section may be narrow rock ridges at the maximum height of the pillars.

The narrow rock ridges for each drawbell may be quadrilateral with one pair of parallel longer rock ridges and another pair of shorter parallel rock ridges.

Each drawbell may be a "regular" layout that is formed so that (a) each longer rock ridge is spaced above and mid-way between two adjacent drawbell drives and (b) each shorter rock ridge is spaced above a centreline of an extraction drive.

Alternatively, each drawbell may be a "staggered" layout that is formed so that (a) each longer rock ridge is spaced above and mid-way between two adjacent drawbell drives and (b) each shorter rock ridge is spaced above and extends transverse to an extraction drive.

3. Method of Drilling and Blasting Drawbells

The applicant has recognised that a single pass cave establishment block cave of invention 1, i.e. a block cave having a single extraction level and no undercut level with high draw column heights of at least 450 m, requires a particular multiple drill and blast method for forming the drawbells of the block cave.

It is noted that the particular multiple drill and blast method of the invention is not confined to forming drawbells in block caves having high draw column heights of at least 450 m.

In broad terms, another invention provides a method of drilling and blasting a drawbell in a block cave, with the block cave having a single extraction level and no undercut level and the extraction level including a layout of a plurality of drawbell drives and a plurality of extraction drives that intersect the drawbell drives, with the method including forming the drawbell in a sequence of at least 3 separate sections.

The method may include forming the drawbell in a sequence of 3 separate sections.

The method may include forming the drawbell in a sequence of 4 separate sections.

The method may include forming the drawbell in a sequence of 5 separate sections.

The method may include forming a first section of the drawbell by drilling an uphole raise, typically having a diameter of at least 1 m, upwardly from a drawbell drive in an extraction level of the block cave and then drilling holes around the uphole raise and charging explosives into the holes and initiating the explosives to form the first section.

The first section may be any suitable shape and dimensions.

By way of example, the first section may be a slot extending across the width of the drawbell with a length of at least 1.5-2 m in the direction of the drawbell drive.

The first section provides a void for firing a second section of the drawbell, described below.

The method may include forming a second section of the drawbell by the steps of:

(a) drilling holes upwardly from the drawbell drive in a section of the rock mass that is adjacent the first section on one side of the first section;
(b) loading explosives in holes in the section;
(c) initiating the explosives and forming the second section.

The method may include forming a third section of the drawbell by the steps of:

(a) drilling holes upwardly from the drawbell drive in a section of the rock mass that is adjacent the first section on the other side of the first section;
(b) loading explosives in holes in the section; and
(c) initiating the explosives and forming the third section.

The drilling steps for forming the first, second, and third sections may be carried out before any of the sections is filled with explosives.

When the method comprises forming the drawbell in a sequence of 4 or more separate sections, the method may include forming a fourth section of the drawbell by the steps of:

(a) drilling holes upwardly from the drawbell drive in a section of the rock mass that is adjacent the second section or the third section;
(b) loading explosives in holes in the section; and
(c) initiating the explosives and forming the third section.

The fourth section may be above what becomes an apron section of the drawbell and, in that event, the method may include drilling holes vertically upwardly from the drawbell drive and stemming the holes below what will become the apron of the drawbell so as not to blast rock mass in this section.

When the method comprises forming the drawbell in a sequence of 5 or more separate sections, the method may include forming a fifth section of the drawbell by the steps of:

(a) drilling holes upwardly from the drawbell drive in a section of the rock mass that is on the other side of the drawbell to the fourth section;
(b) loading explosives in holes in the section; and
(c) initiating the explosives and forming the third section.

The fourth section may be above what becomes an apron section of the drawbell and, in that event, the method may include drilling holes vertically upwardly from the drawbell drive and stemming the holes below what will become the apron of the drawbell so as not to blast rock mass in this section.

The drilling steps for forming the fourth and the fifth sections may be carried out before any of the sections is filled with explosives.

4. Method of Establishing a Block Cave Invention

The applicant has recognised that a single pass cave establishment block cave of invention 1, i.e. a block cave having a single extraction level and no undercut level with high draw column heights of at least 450 m, can be formed by two particular methods of establishing the block cave.

In broad terms, another invention provides a method of establishing a block cave having a single extraction level and no undercut level with high draw column heights of at least 450 m that comprises the following steps:

(a) excavating an extraction level including a layout of a plurality of drawbell drives and a plurality of extraction drives that intersect the drawbell drives; and (b) drilling blast holes upwardly into the rock mass from the drawbell drives in the extraction level and positioning and detonating explosives in at least some of those holes to fracture rock mass above the extraction level and form an array of the drawbells having the drawbell profile defined in invention 2 that are separated by pillars that support the rock mass above the extraction level, with the drawbells having undercut sections that interconnect the drawbells in the direction of the drawbell drives and in the direction of the extraction drives.

Alternatively, the other invention may be defined as a method of establishing a block cave having a single extraction level and no undercut level with high draw column heights of at least 450 m that comprises the following steps:

(a) excavating an extraction level including a layout of a plurality of drawbell drives and a plurality of extraction drives that intersect the drawbell drives; and (b) drilling blast holes upwardly into the rock mass from the drawbell drives in the extraction level and positioning and detonating explosives in at least some of those holes to fracture rock mass above the extraction level in accordance with the multiple drill and blast sequence for forming drawbells of the method of invention 3 and forming an array of drawbells separated by pillars that support the rock mass above the extraction level, with the drawbells having upper undercut sections that interconnect the drawbells in the direction of the drawbell drives and the direction of the extraction drives.

The method may include extending the block cave from the initially established footprint described in each of the two preceding paragraphs in any suitable direction of cave establishment, as described herein, may be any suitable direction.

The term "direction of cave establishment" is understood herein to mean a direction in which a block cave is extended progressively over the life of the block cave.

The extraction drives may be parallel to the direction of cave establishment.

The drawbell drives may be parallel to the direction of cave establishment.

The extraction level layout may be any suitable layout of parallel extraction drives and parallel drawbell drives.

As noted above in relation to invention 1, by way of example, the layout may be any one or more of the layouts known as an El Teniente layout, a Herringbone layout, or a Henderson layout or any other suitable layout.

The following description is in the context of an El Teniente layout having straight parallel extraction drives and straight parallel drawbell drives that are transverse to the extraction drives.

The drawbell drives may be at an angle of at least 30° to the extraction drives.

The drawbell drives may be at an angle of at least 45° to the extraction drives.

The drawbell drives may be at an angle of at least 55° to the extraction drives.

The drawbell drives may be at an angle of up to 90° to the extraction drives.

The method may include pre-conditioning the rock mass above the extraction level by fracturing the rock mass via pre-conditioning actions and thereby assisting subsequent removal of the rock mass via the extraction level.

The pre-conditioning may be via:

(a) hydraulic fracturing of the rock mass volume to be caved, and/or (b) large-scale confined blasting of at least a part of the rock mass volume to be caved.

Pre-Conditioning Enabler (b)

The term "preconditioning" is understood herein to mean the implementation of processes to modify a rock mass to enable better control or management of the cave mining process.

The term "modify" is used in this context to mean processes of artificially induced changes to the rock mass through:

(a) hydraulic fracturing of the rock mass volume to be caved, and/or (b) large-scale confined blasting of the rock mass volume to be caved.

These processes involve treating or modifying the characteristics of the rock mass using fluid injection or fully confined blasting. Intensive preconditioning occurs when a combination of hydraulic fracturing and confined blasting is used.

Key benefits for a block cave are:

Improved caveability (ability of a rock mass to cave after its base has been undercut).

Improved cave propagation rate (relative velocity at which the cave is propagated vertically as a response to extraction).

Improved seismic response during all the stages of the caving process (improves safety for people, equipment and installations).

Improved cave fragmentation (the rock mass degrades into smaller fragments which makes the extraction process more continuous and efficient).

Improved cave growth geometry (the cave propagates along the planned ore volume which helps control dilution and undesired propagation deviation).

Pre-conditioning a rock mass via hydraulic fracturing of a rock mass to be caved from a surface of a mine or an upper level of the mine accelerates cave propagation, manages high rock stresses, and reduces early fragmentation size and downstream secondary breakage requirements.

The purpose of pre-conditioning from the surface or an upper level of the mine is to fracture the rock mass in order to create fractures, effect a reduction in rock mass quality, reduce the modulus of elasticity of the rock mass, improve fragmentation, and reduce the capacity of the rock to transmit/convey stress.

Pre-conditioning from the surface or an upper level of the mine may include using hydraulic fracturing as one option to fracture the rock mass.

The term "hydraulic fracturing" (also known as fracking) is understood herein to mean a borehole stimulation technique in which a rock mass is fractured by a pressurized liquid or alternative agent (i.e. gas/propellent etc.). The process involves high-pressure injection of fracking fluid/agent (primarily water, containing sand or other proppants suspended with the aid of thickening agents) into a borehole to create cracks in the rock formations.

Preconditioning from the surface or an upper level of the mine assists in ensuring sufficient initiation of a block cave as it reduces the rock mass quality and reduces the critical hydraulic radius required before caving commences.

Hydraulic fracturing not only helps to degrade the rock mass strength to reduce the critical hydraulic radius required before cave initiation, it also helps to manage stress levels within the rock mass thereby reducing magnitude and frequency of mining induced seismicity. A more broken, "softer" and elastic rock mass has less capability to convey/transmit rock stress and therefore actual stress levels encountered are generally reduced. Hydraulic fracturing also assists in improving early fragmentation and therefore reduces the need for secondary breakage of oversized fragments during mining production activities.

Pre-conditioning a rock mass via confined blasting of the rock mass volume to be caved involves drilling holes upwardly into the rock mass to be caved from the extraction level or a higher level, positioning explosives in the drilled holes, grouting the lower sections of the holes to confine the explosives and ensure energy is released into the rock mass as opposed to existing excavations, and initiating the explosives to form fractures in the rock mass.

BRIEF DESCRIPTION OF THE DRAWINGS

In order that the inventions may be more fully explained, embodiments of block cave mining methods and mines are described with reference to the accompanying drawings, in which.

DESCRIPTION OF EMBODIMENTS

As discussed above, FIGS. 1A, 1B, and 1C are diagrammatic conceptual cross-sections of traditional undercut methods, depicting drawbell establishment and development sequences.

Figure 1A:
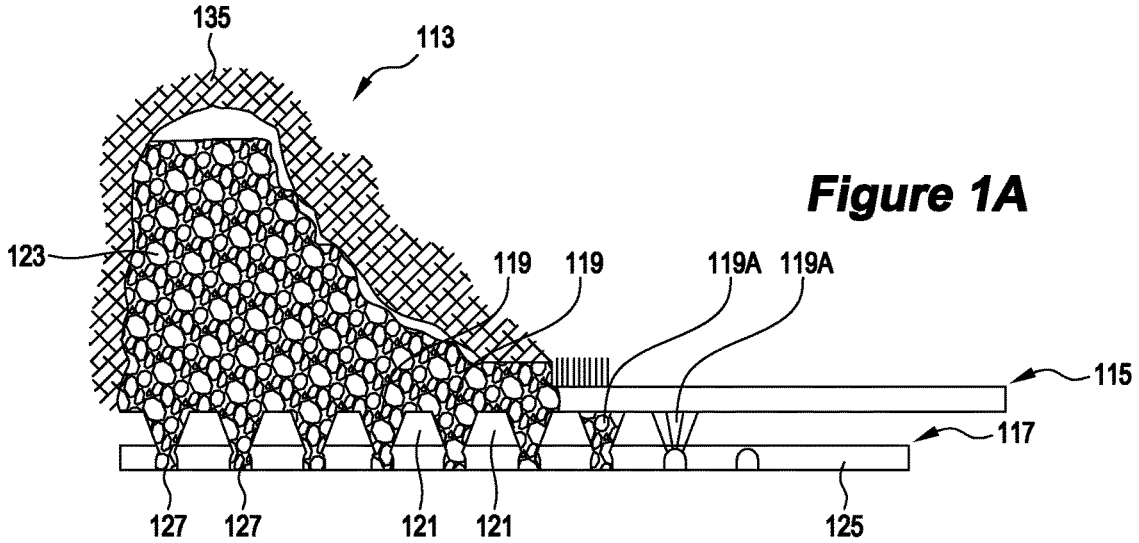
FIGS. 1A, 1B, and 1C are conceptual cross-sections illustrating conventional methods of forming block caves.
Figure 1B:
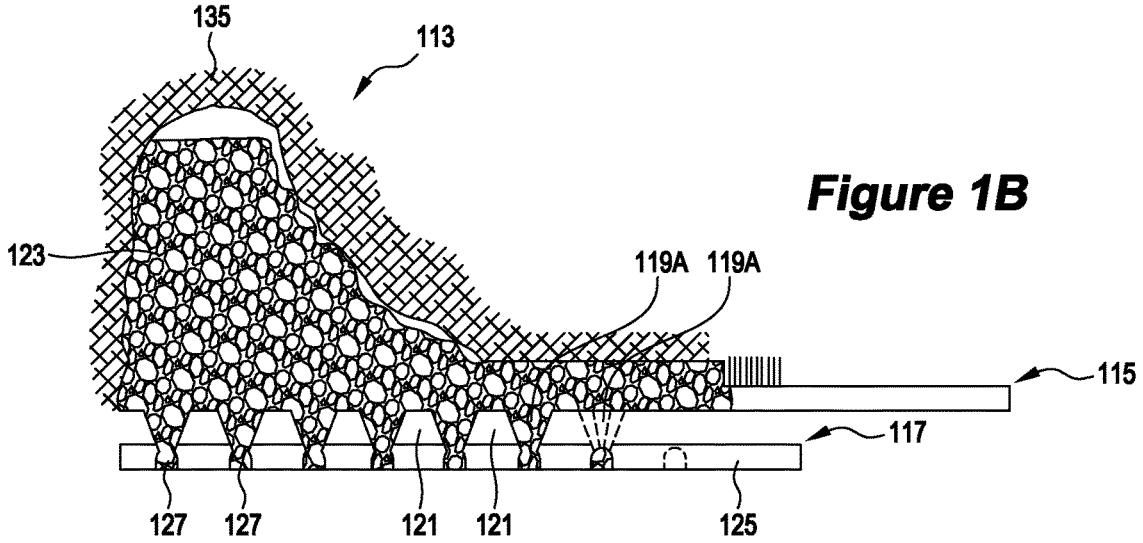
Figure 1C:
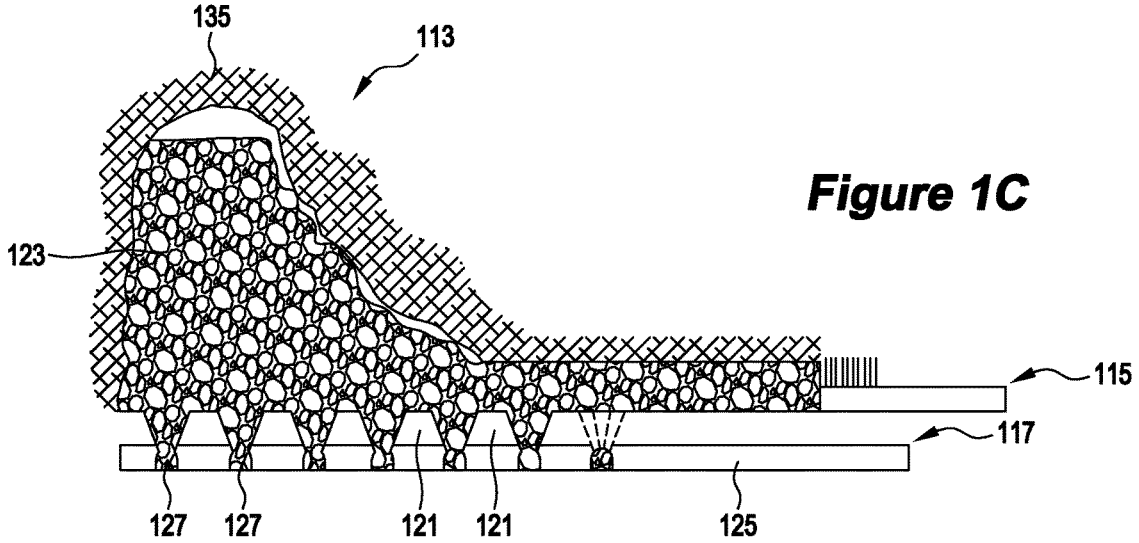

More particularly, FIG. 1A illustrates a typical post-undercutting method, FIG. 1B illustrates a typical advanced undercutting method, and FIG. 1C illustrates a typical pre-undercutting method for forming extraction levels 117 and undercut levels 115 in block caves 113.

The extraction level 117 and the undercut level 115 in each Figure are at different heights of the block cave 113 and are interconnected by a plurality of drawbells 119.

The undercut level 115 in each Figure facilitates creating a caved volume 123 containing caved rock above a draw horizon and within a rock mass 135.

The drawbells 119 define volumes extending between upper and lower ends of the drawbells that allow rocks to flow downwardly from the caved volume 123 into the extraction level 117.

The extraction level 117 in each Figure functions to allow caved rocks to be extracted from the drawbells 119 in those locations where the drawbells 119 are open and connected to the undercut level 115.

The extraction level 117 in each Figure comprises an array of parallel extraction drives 125 (only one of which is shown in each of the Figures) and an array of parallel drawbell drives 127 (extending from the page of each Figure) that intersect the drawbell drives 125.

The rock in the caved volume 123 and the rock mass 135 above the caved volume 123 are supported by an array of interconnected pillars 121. The cross-sections in FIGS. 1A, 1B, and 1C do not show the array of interconnected pillars 121. However, these arrays are well-known to the skilled person.

In the post-undercutting method of FIG. 1A, new drawbells 119A are formed (typically by drilling and blasting) upwardly from the extraction level 117 before blasting the rock mass above the undercut level 115 in the region of the drawbells 119A. This blasting process is illustrated by the drilled holes 137 in the Figure. In this method, the development of the new drawbells 119 from the extraction level 117 is ahead of the development of the undercut level 115. Specifically, the new drawbells 119A are formed before blasting the rock mass above the undercut level 115 in the region of the drawbells 119A.

In the advanced undercutting method of FIG. 1B, new drawbells 119A are formed (by drilling and blasting) upwardly from the extraction level 117 after blasting the rock mass above the undercut level 115 in the region of the drawbells 119A. In this method, the development of the new drawbells 119A follows blasting the rock mass above the undercut level 115 in the region of the new drawbells 119A.

In the pre-undercutting method of FIG. 1C, new drawbells 119A are formed (by drilling and blasting) upwardly from the extraction level 117 after blasting the rock mass above the undercut level 115 in the region of the drawbells 119A. In this method, the development of the new drawbells 119A follows blasting the rock mass above the undercut level 115 in the region of the new drawbells 119A.

Figure 2:
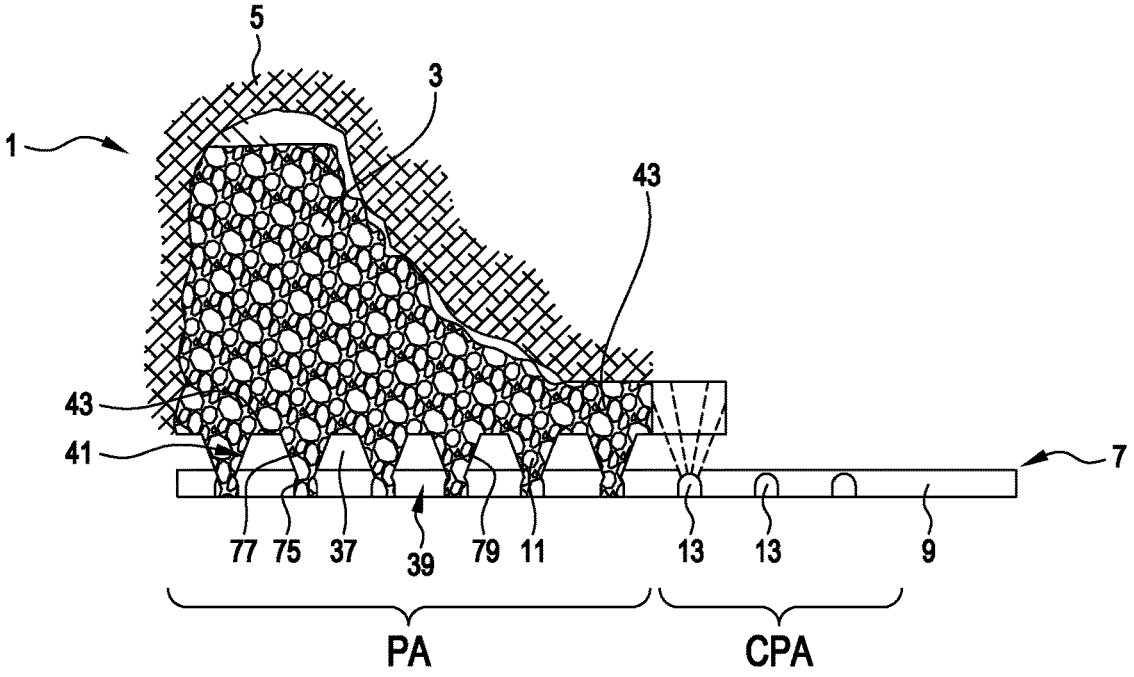
FIG. 2 is a diagrammatic conceptual cross-section illustrating an embodiment of a method of forming a block cave in accordance with the invention.

FIG. 2 is a diagrammatic conceptual cross-section of an embodiment of a method of forming a block cave in accordance with the invention.

FIG. 2 illustrates an embodiment of the concept that is an integrated drilling and blasting cave establishment method in which opening drawbells and undercutting are, in effect, performed simultaneously from an extraction level, without the need for a dedicated undercut level.

More particularly, FIG. 2 illustrates an embodiment of a method of establishing a block cave, generally identified by the numeral 1, in accordance with the invention having a single extraction level 7 and no undercut level with high draw columns of at least 450 m.

FIG. 2 shows that the block cave 1 comprises:

(a) a caved volume 3 containing caved rock within a rock mass 5 with the caved rock moving downwardly within the block cave 1;

(b) the extraction level 7 of the block cave 1 for removing fractured rock mass from the caved volume 3, with the extraction level comprising a layout of a plurality of parallel drawbell drives 9 (one of which is shown in the Figure) and a plurality of parallel, transverse extraction drives 13 extending from the page that intersect the drawbell drives 9, with the extraction level 7 being provided for receiving rocks from the caved volume 3 via the drawbells 11 to be transported via excavator and haulage vehicles or other suitable vehicles via the drawbell drives 9 and the extraction drives 13 from the extraction level 7 for further processing to recover valuable metals form the rocks;

(c) a plurality of drawbells 11 defining volumes extending between and interconnecting the caved volume 3 and the drawbell drives 9 through which caved rocks flow downwardly from the caved volume 3 into the drawbell drives 9; and (d) a plurality of pillars 37 separating the drawbells 11 and supporting rocks in the caved volume 3 and the rock mass 5 above the caved volume 3 above the extraction level 7.

The method shown in FIG. 2 comprises establishing and then extending the drawbell drives 9 and the transverse extraction drives 13 ahead of the drawbells 11 and drilling and blasting successive drawbells 11 upwardly from the drawbell drives 9 and, in effect, opening the drawbells 11 to the caved volume 3 so that rock can flow downwardly from the caved volume 3 through the drawbells 11 to the extraction level 7 and be removed from the extraction level 7 as described above.

More particularly, the method shown in FIG. 2 comprises the following steps:

(a) excavating the extraction level 7 including the layout of the plurality of parallel drawbell drives 9 and the plurality of parallel extraction drives 13 that intersect the drawbell drives 9—typically using standard drilling and blasting options well known to the skilled person; and (b) progressively forming the drawbells 11 upwardly from the extraction level 7 and opening the drawbells 11 to the caved volume 3 by drilling and blasting to establish and then extend the block cave 1, noting that FIG. 2 identifies a production area PA that indicates a section of established block cave 1 and a cave preparation area CPA that indicates a new section of the block cave 1 that is being established.

The layout of extraction drives 13 and drawbell drives 9 in the extraction level 7 may be any suitable layout.

In the present instance, the extraction level layout shown in FIG. 2 and other Figures in the specification is an El Teniente layout having straight extraction drives 13 and straight drawbell drives 9 that are transverse to each other at an angle of approximately 60°.

Alternatives to the El Teniente extraction level layout include, by way of example, a Herringbone layout and a Henderson layout, well known to the skilled person.

It is noted that the invention is not confined to a particular extraction level layout.

Method step (b) above comprises forming drawbells 11 by drilling blast holes upwardly into the rock mass from the drawbell drives 9 in the extraction level 7 and positioning and detonating explosives in at least some of those holes and fracturing rock mass above the extraction level 7, with the fractured rocks falling into the drawbell drives 9 and being removed by excavator and haulage vehicles or other suitable vehicles.

Ultimately, after the required drilling and blasting operations, the drawbells 11 are formed as voids (i.e. empty volumes) having the required profile, with the voids in the upper end regions (undercut sections) of the drawbells 11 being interconnected.

Any suitable drilling and blasting technologies may be used to form the drawbells 11.

The skilled person is aware of a range of known drilling and blasting technologies and can make selections in any given situation having regard to geology, explosives options, and other factors. By way of example, known drilling technologies include top hammer rigs and in-the-hole hammer rigs.

The drilling and blasting steps are designed to form an array of the drawbells 11 that are separated by the pillars 37 that support the rock mass above the extraction level 7, with the drawbells 11 having a selected profile described further below that has (a) upper regions (undercut sections) that interconnect the drawbells 11 in the direction of the drawbell drives 9 and in the direction of the extraction drives 13 and (b) lower regions (throat and tapered sections) that direct the flow of rock downwardly from the upper regions to the extraction level 7.

The profiles of the pillars 37 of the block cave 1 shown in FIG. 2 have the following profile in a direction of the drawbell drives 9 in the extraction level 7, i.e. when viewed in a direction perpendicular to the direction of the drawbell drive 9 (for example as viewed in FIGS. 2, 3 and 5):

(a) a base section 39 having opposed parallel side walls 75 extending perpendicular, although could be tapered inwardly, to the extraction level 7, and (b) an upper inwardly tapered section 41 having side walls 77 extending inwardly towards each other from upper ends of the side walls 75 of the base section 39 and terminating in an apex section 43.

It is noted that the apex sections 43 of the pillars 37 shown in FIG. 2 are flat narrow sections (shown as flat ridges 49 in FIG. 10F) and that in other embodiments of the invention described below the apex sections are considerably narrower and are apices that form rock ridges 33—for example, see FIG. 10F.

As is described further below, the flat ridges 43, 49 are formed in the process of forming a new drawbell 11 that is adjacent existing drawbells 11. The rock ridges 33 also tend to form as flat ridges. It is noted that in practice, the flat ridges 49 are not actually flat as shown diagrammatically in the Figures but are domed to an extent—given the way in which they are formed.

Figure 3:
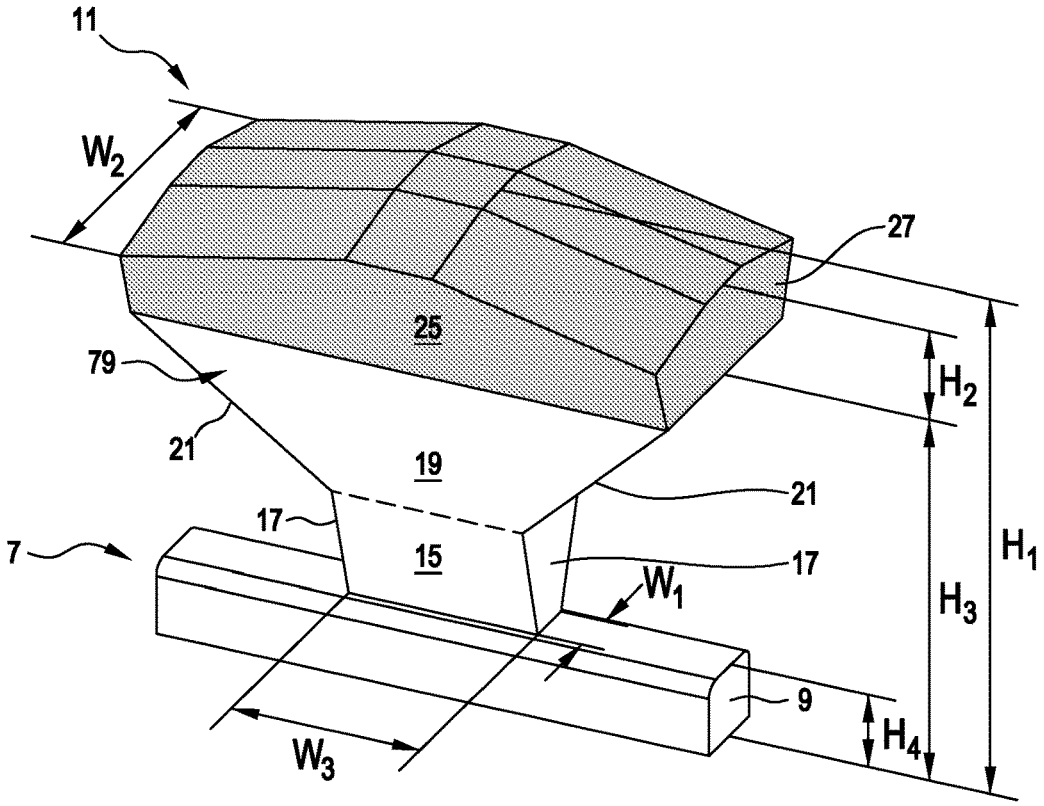
FIG. 3 is a diagrammatic perspective view of an embodiment of a drawbell profile in accordance with the invention, as tested in a trial at the Telfer mine of the applicant.

FIG. 3 is a perspective view of an embodiment of a drawbell 11 in accordance with the invention, as tested in a trial at the Telfer mine of the applicant, described further below.

FIG. 3 shows a single drawbell 11 extending upwardly from a drawbell drive 9 of an extraction level 7.

Figure 5:
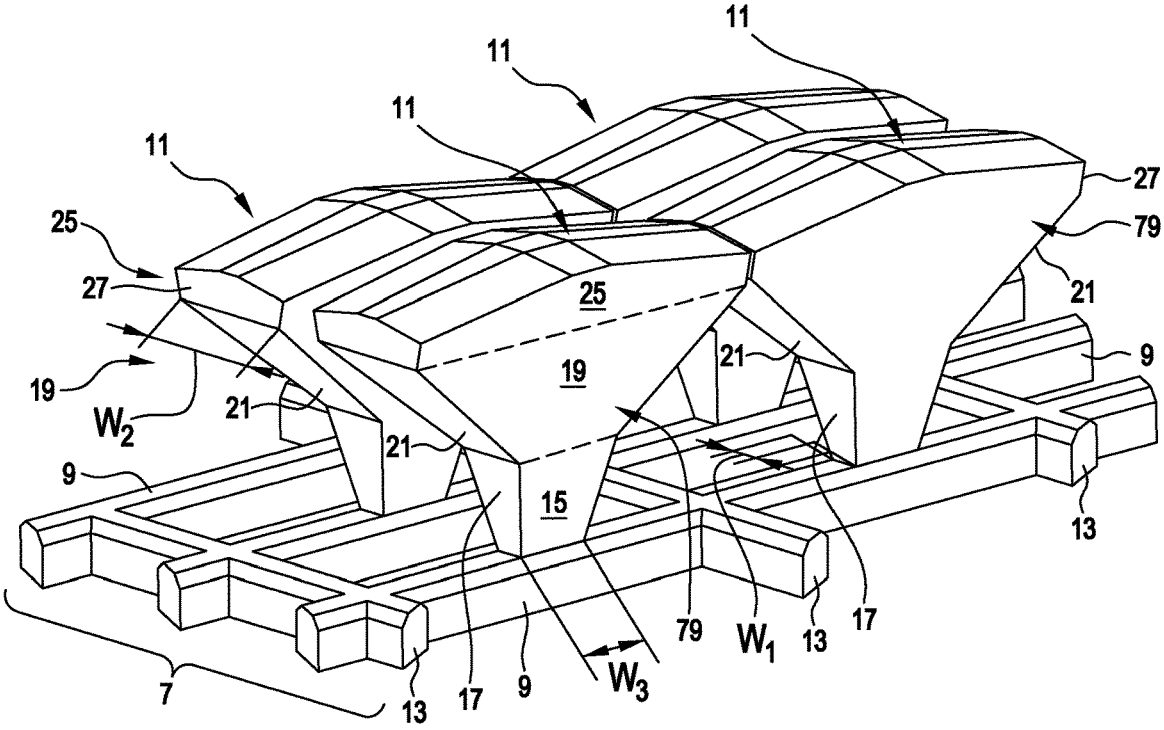
FIG. 5 is a diagrammatic perspective view of the planned drawbell design of the Telfer trial.

FIG. 5 shows an arrangement of four of the drawbells 11 formed in the Telfer trial extending upwardly from drawbell drives 9 of an extraction level 7.

FIGS. 8, 9, 10A to 10F show more information on the arrangement of the four drawbells 11 in the Telfer trial.

Figure 10A:
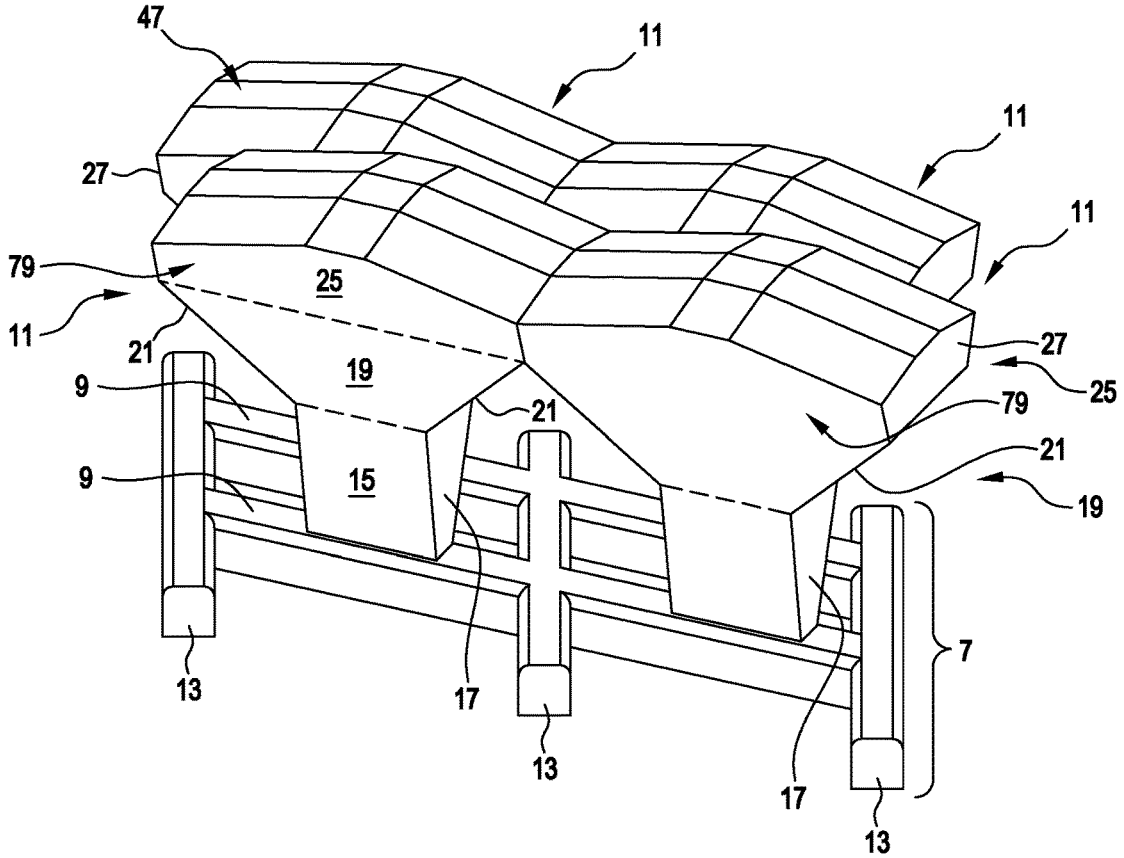
FIG. 10A is a diagrammatic perspective view, similar to FIG. 5, of the planned drawbell design of the Telfer trial, with this drawing and the other drawing in the sequence of FIGS. 10B to 10F illustrate one embodiment of an arrangement of drawbells in accordance with the invention.
Figure 10B:
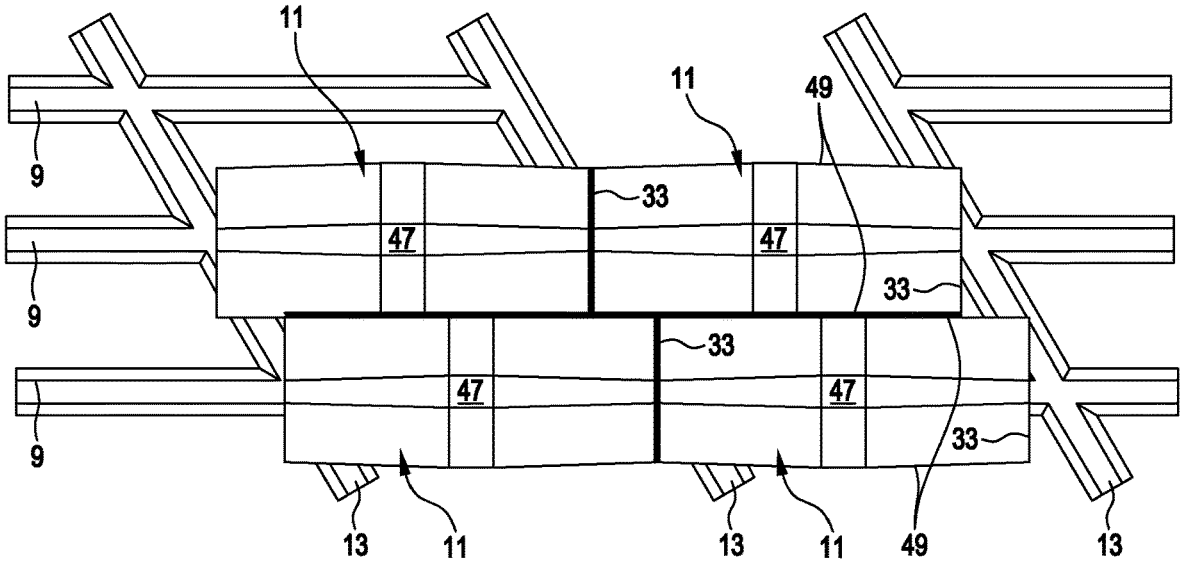
FIG. 10B is a diagrammatic plan view of the planned layout of the extraction and drawbell drives and the drawbells extending above these drives for the Telfer mine trial.
Figure 10C:
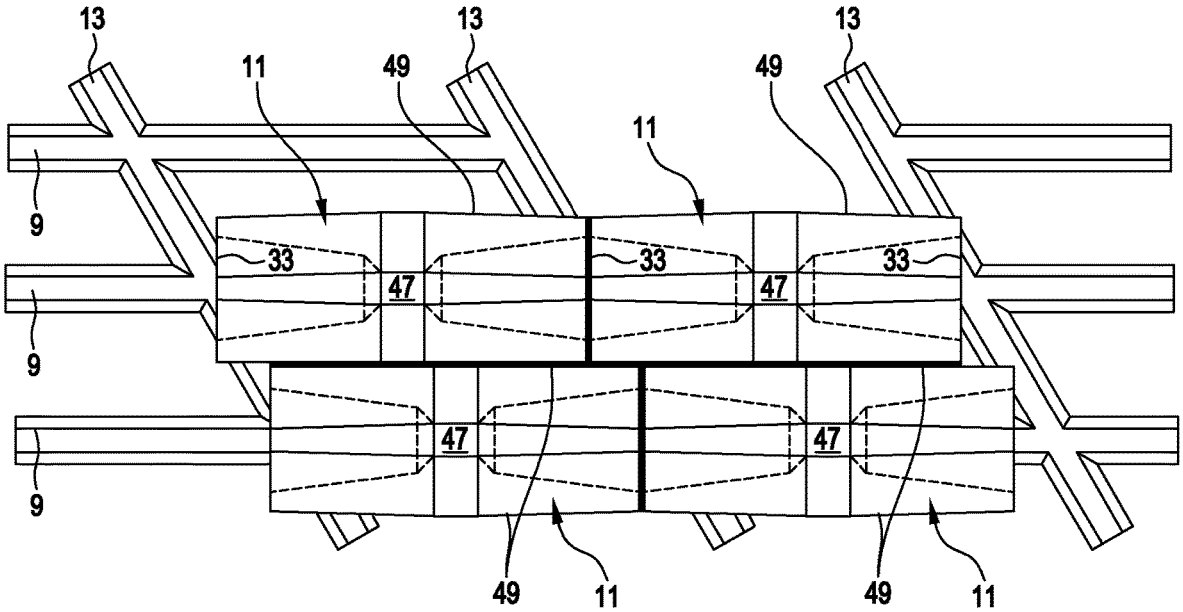
FIG. 10C is another diagrammatic plan view similar to FIG. 10B but also having contour lines (as dashed lines) showing the drawbell profile from an upper drawbell opening to the drawbell drive opening.
Figure 10D:
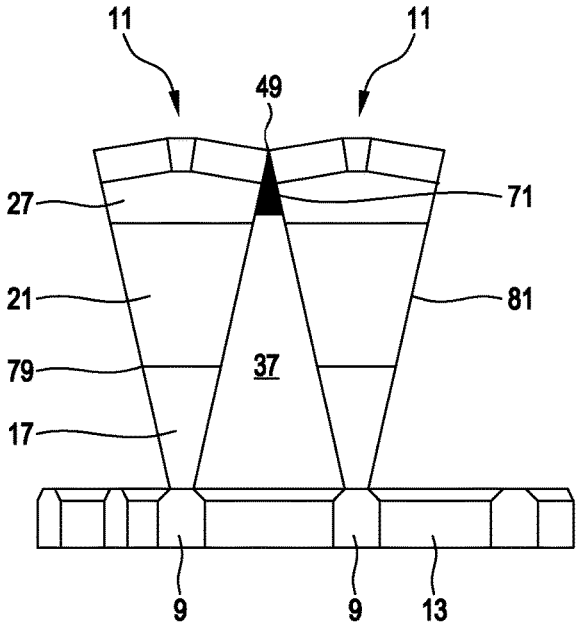
FIG. 10D is a diagrammatic end view of the planned drawbell design of the Telfer trial.
Figure 10E:
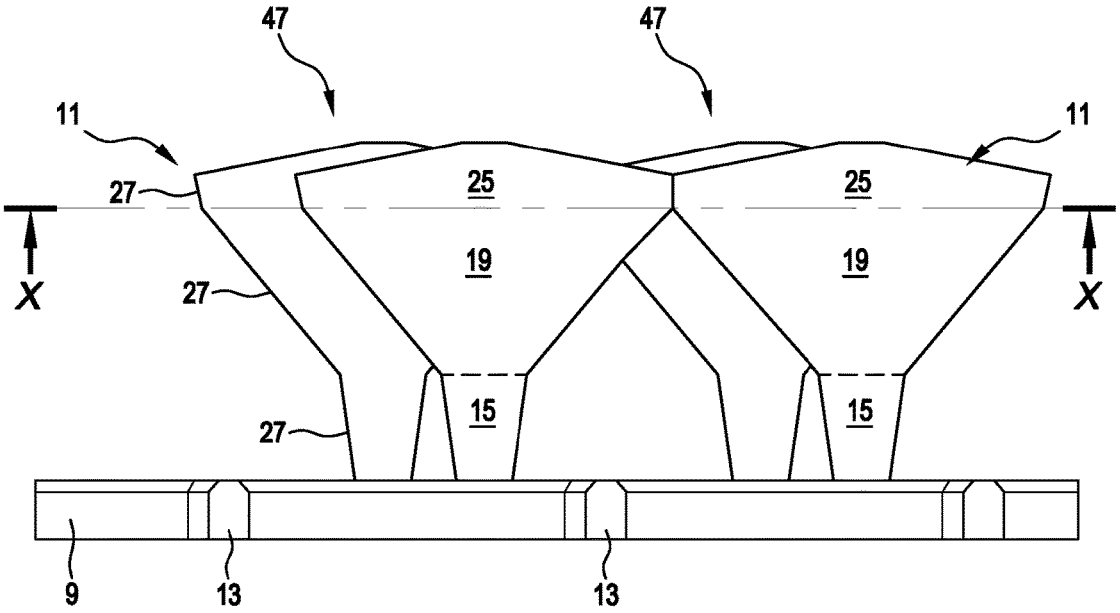
FIG. 10E is a diagrammatic perspective view, similar to FIGS. 5 and 10A, of the planned drawbell design of the Telfer trial, with a section line X-X.

It is noted that the array of interconnected pillars 37 that are positioned between and define the drawbells 11 and support the rock mass above the drawbells 11 are not shown in FIGS. 5, 10A and 10E to allow the profiles of the drawbells 11 to be seen clearly in these Figures. FIG. 10D shows a pillar 37 from one direction.

The pillar arrangement can be appreciated from the plan view of FIG. 10C that has contour lines that indicate the drawbell profiles and by extension the pillar profiles looking downwardly through the height of the drawbells 11.

Figure 8:
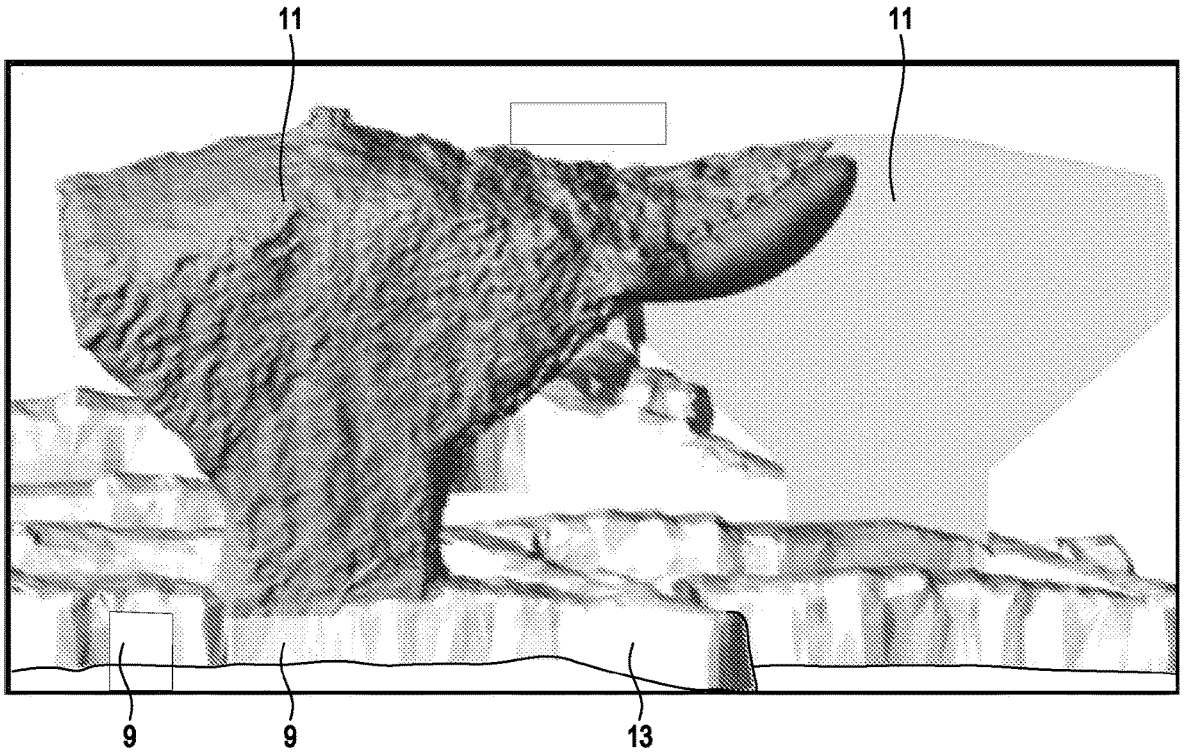
FIG. 8 is a drone scan image of a drawbell formed in the Telfer mine trial.
Figure 9A:
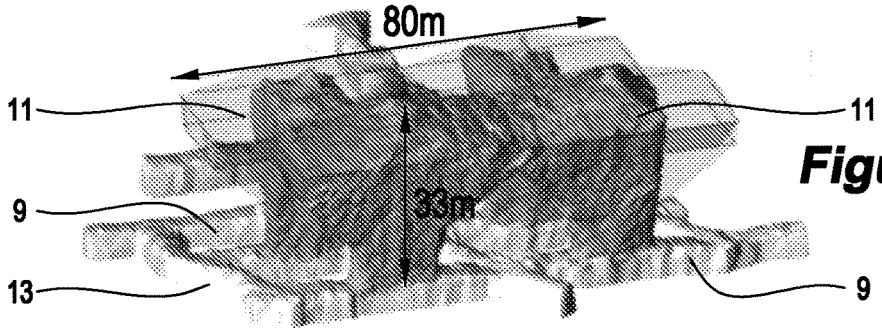
FIGS. 9A, 9B, 9C and 9D are drone scan images and cross-sectional views, respectively, that illustrate the drawbells formed in the Telfer mine trial.
Figure 9B:
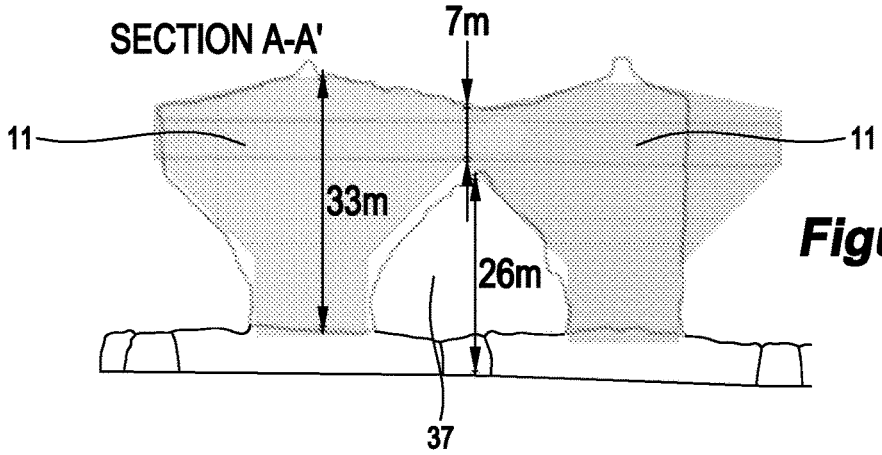
Figure 9C:
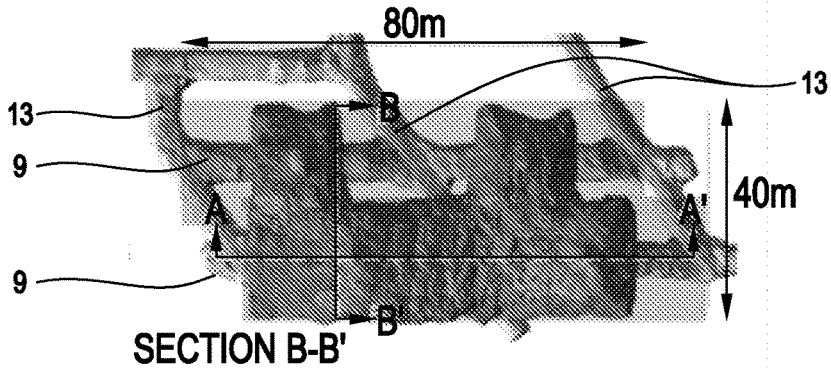
Figure 9D:
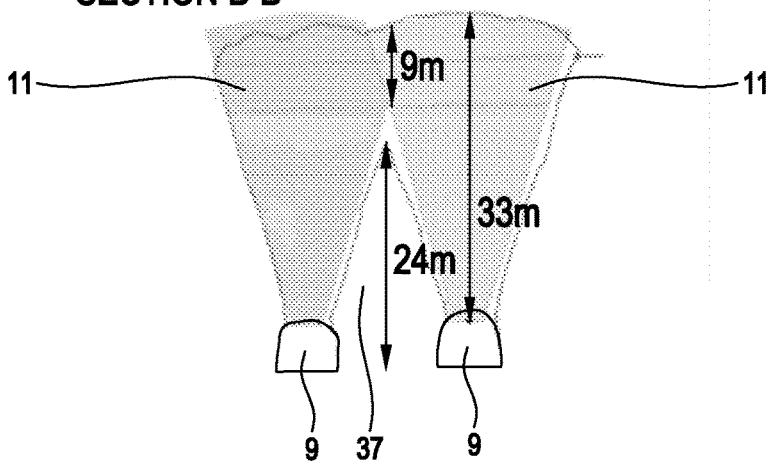

The pillar arrangement can also be appreciated from the drone scan image of a drawbell formed in the Telfer mine trial shown in FIG. 8 and the drone scan images and cross-sectional views of the arrangement of 4 drawbells 11 formed in the Telfer mine trial shown in FIGS. 9A, 9B, 9C and 9D. The cross-sectional view in FIG. 9B is a cross-section along the line A'-A' in FIG. 9C. The cross-sectional view in FIG. 9D is a cross-section along the line B'-B' in FIG. 9C. The drone scan images in FIGS. 8, 9A and 9C were taken before all of the 4 drawbells 11 were formed.

It is also noted that the drawbells 11 shown in FIGS. 3, 5, and 10A to 10F. (and other Figures) are, in effect, voids (i.e. empty volumes) formed by removing rock removed from the rock mass in a drill and blast method of forming the drawbells 11. The drawbell shapes shown in the Figures are the void shapes. These voids are quickly filled by rocks from the caved volume 3 after block cave mining commences, with rocks moving downwardly from the caved volume 3 through the drawbell voids and filling the voids and being removed from drawbell drives 9 by excavator and haulage vehicles or other suitable vehicles and transported from the extraction level 7 for further processing to recover valuable metals form the rocks.

It is also noted that the drawbells 11 shown in FIGS. 3, 5 and 10A to 10F are shown as preferred profiles and, in practice, it may not always be possible to drill and blast a rock mass to precisely form the profiles. This is illustrated by the drone scans and cross-sections of FIGS. 8 and 9.

With reference to FIGS. 5, 6, and 10A to 10F. (and as is also evident from the drone scans and cross-sections of FIGS. 8 and 9), the Figures shows a layout of a plurality (two in this embodiment) of parallel drawbell drives 9 and a plurality (three in this embodiment) of parallel, transverse extraction drives 13 that intersect the drawbell drives 9 and form an extraction level 7 of the block cave 1—similar to that shown in FIG. 2.

As can best be seen in FIGS. 10B, 10C, and 10F, as described with reference to the orientation of the Figures, the "upper" row of 2 drawbells 11 is staggered a short distance to the left of the "lower" row of 2 drawbells 11. Basically, the positions of the drawbells 11 follow the angle of the extraction drives 13 so that the drawbells 11 are centrally positioned between adjacent extraction drives 11.

It is noted that typically, there may be at least 100, typically at least 150, drawbells 11 in a mine.

It is noted that the upper regions (i.e. the undercut sections 25) of the drawbells 11 interconnect the drawbells 11 at this undercut height and form a continuous void across these upper sections that, in practice is filled with fragmented rock.

With reference to FIGS. 3, 5 and 10A to 10F. (and as is also evident from the drone scans and cross-sections of FIGS. 8 and 9), each drawbell 11 has the following profile in a direction of the drawbell drive 9 in the extraction level 7, i.e. when viewed in a direction perpendicular to the direction of the drawbell drive 9 (for example as viewed in FIGS. 3 and 5):

(a) a throat section 15 having opposed parallel side walls 17 extending upwardly, typically perpendicular but could also be angled outwardy, from the extraction level 7, (b) a tapered section 19 above the throat section 15, the tapered section 19 having side walls 21 extending outwardly from upper ends of the side walls 17 of the throat section 15, and (c) an undercut section 25 above the tapered section 19, the undercut section 25 having opposed parallel side walls 27 extending upwardly from upper ends of the side walls 21 of the tapered section 19 and extending upwardly, typically perpendicular but could also be angled outwardy, to the extraction level 7.

The side walls 17 have a width $W_1$ at the base, i.e. the roof, of the extraction level 7 and a larger width $W_2$ at the upper end of the undercut section 25.

The above profile also includes a front wall 79 and a rear wall 81 (see FIG. 10D only). As can best be seen in FIG. 10D, these walls 79, 81 extend upwardly and outwardly from the extraction level 7 to the upper end of the undercut section 25. The front and rear walls 79, 81 have a width $W_3$ at the base of the extraction level 7.

As viewed in FIG. 10D, the drawbells 11 are separated by an upwardly and inwardly tapered pillar 37 that extends between and upwardly from the drawbell drives 9. The pillar 37 terminates at an upper end in an apex, as shown in the Figure, which forms a narrow rock ridge 49—as seen in FIGS. 10B and 10F. The upper section of the pillar is shown as a triangular region 71. In practice, as the second of the 2 drawbells 11 shown in the Figure forms, this triangular region 71 of rock breaks and the apex is a flat (or generally domed) narrow ridge 49.

Figure 10F:
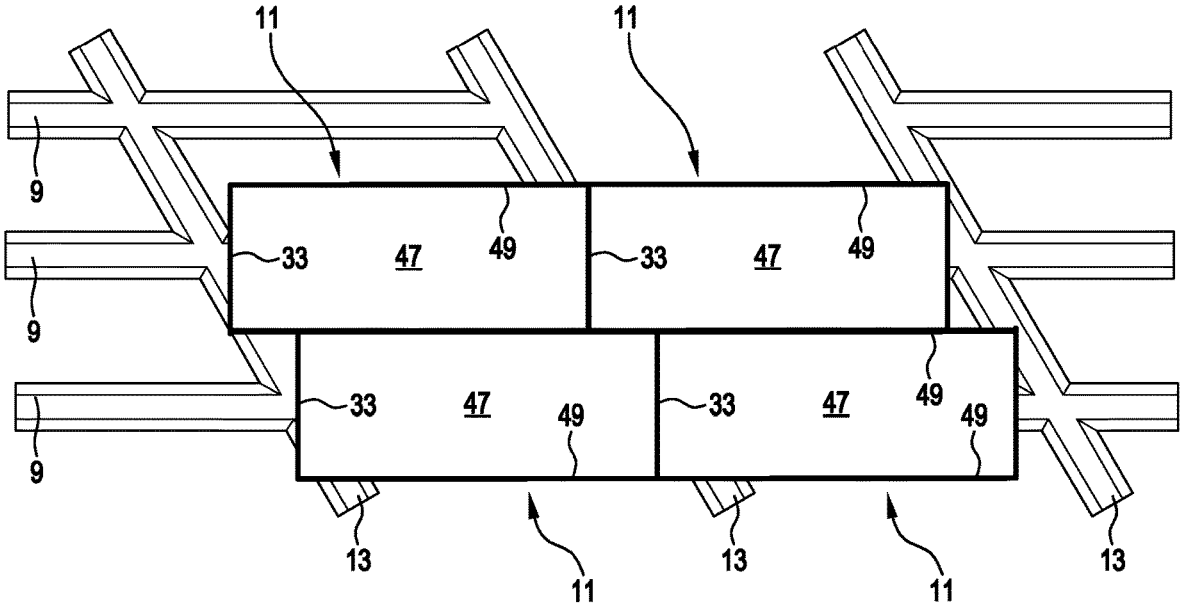
FIG. 10F is a section along the line X-X in FIG. 10E and is a similar plan view to FIG. 10B of the planned layout of the extraction and drawbell drives and the drawbells extending above these drives for the Telfer mine trial.
Figure 11A:
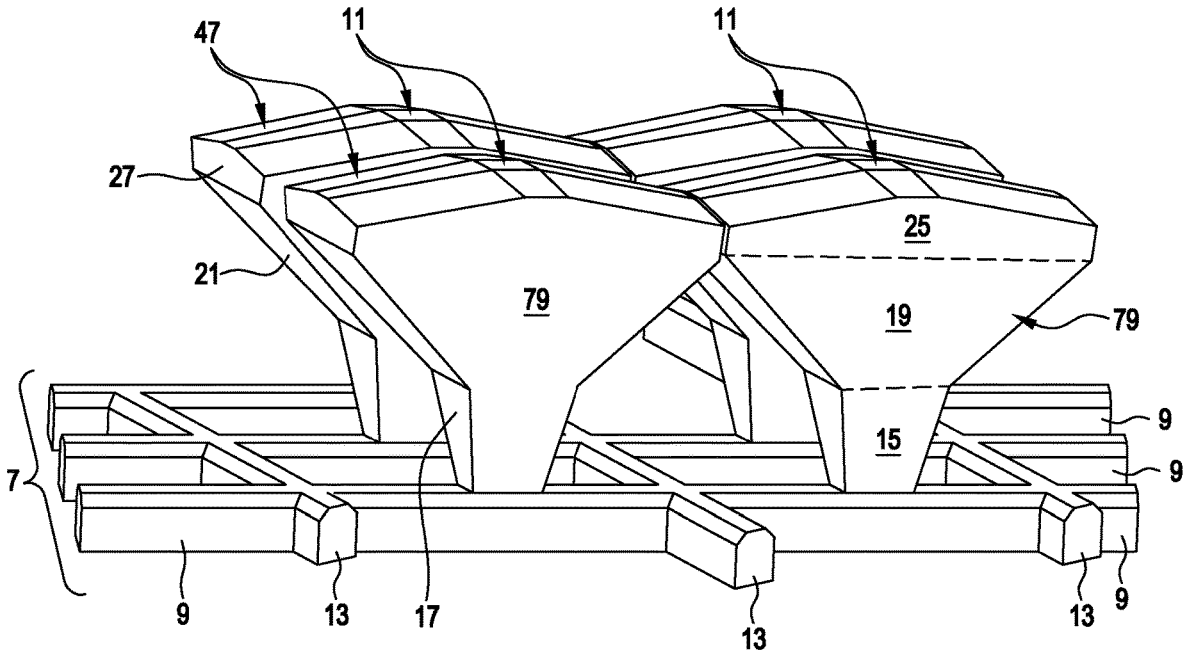
FIGS. 11A to 11F is the same sequence of drawings shown in FIGS. 10A to 10F that shown another embodiment, although not the only other possible embodiment, of an arrangement of drawbells in accordance with the invention.
Figure 11B:
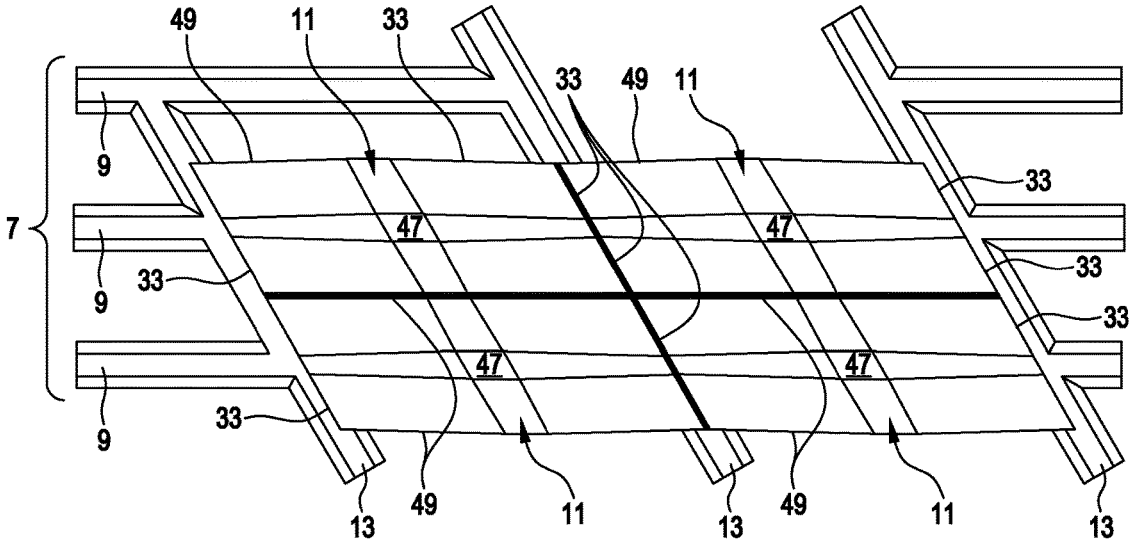
Figure 11C:
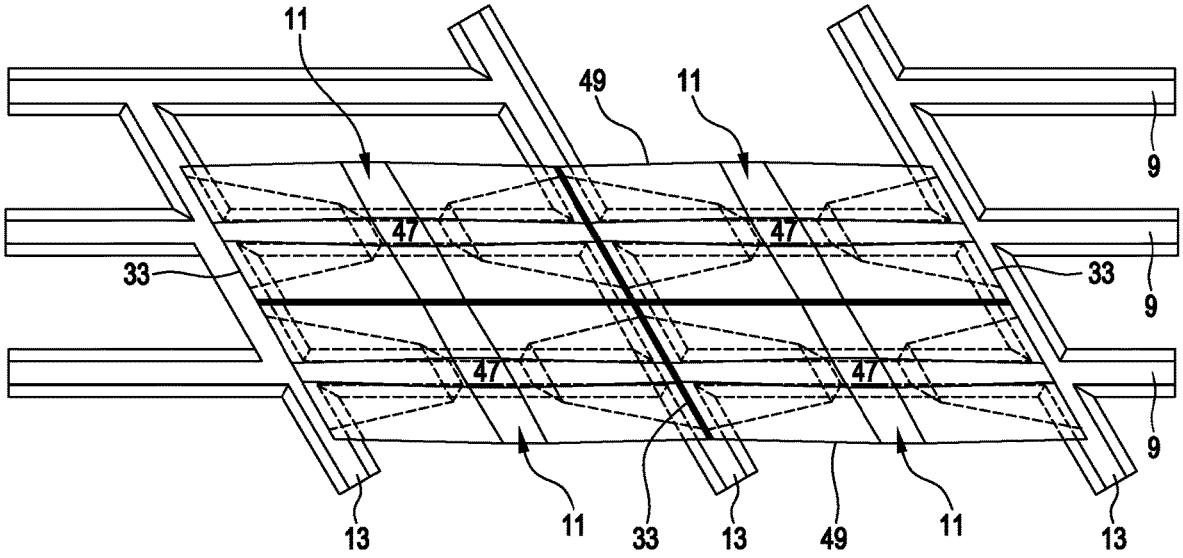
Figure 11D:
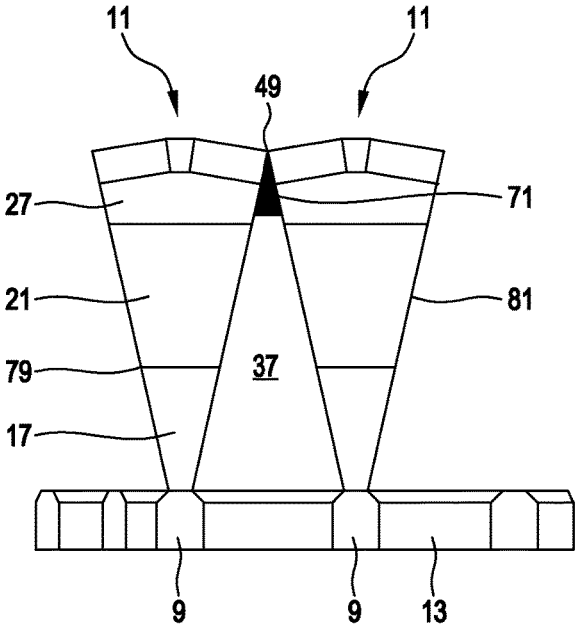
Figure 11E:
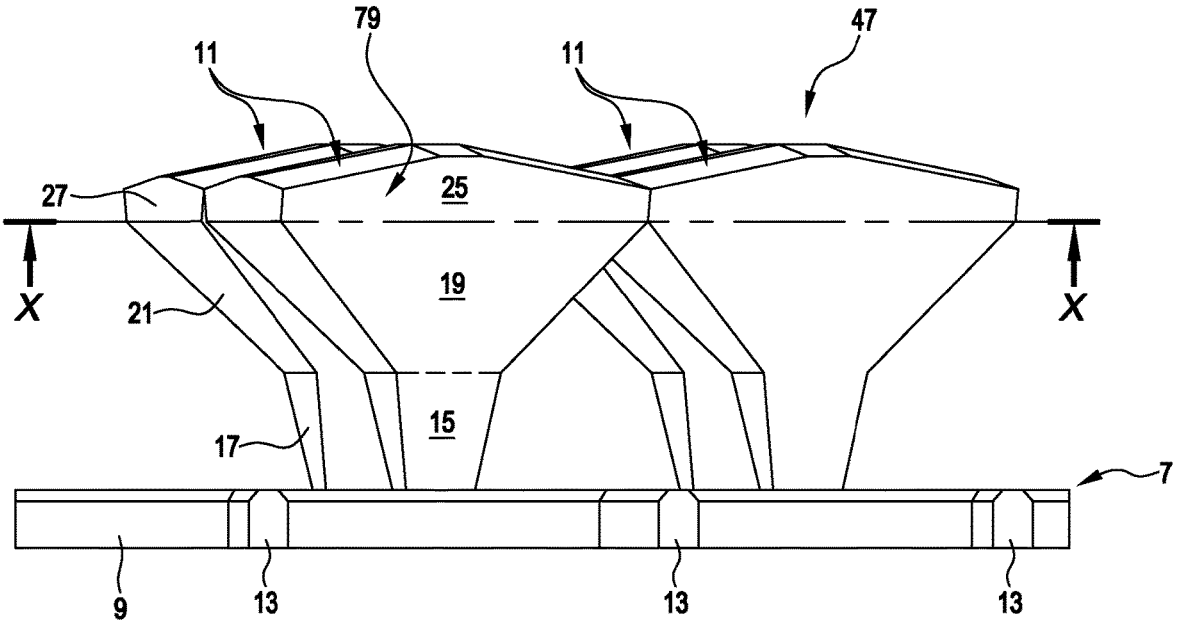
Figure 11F:
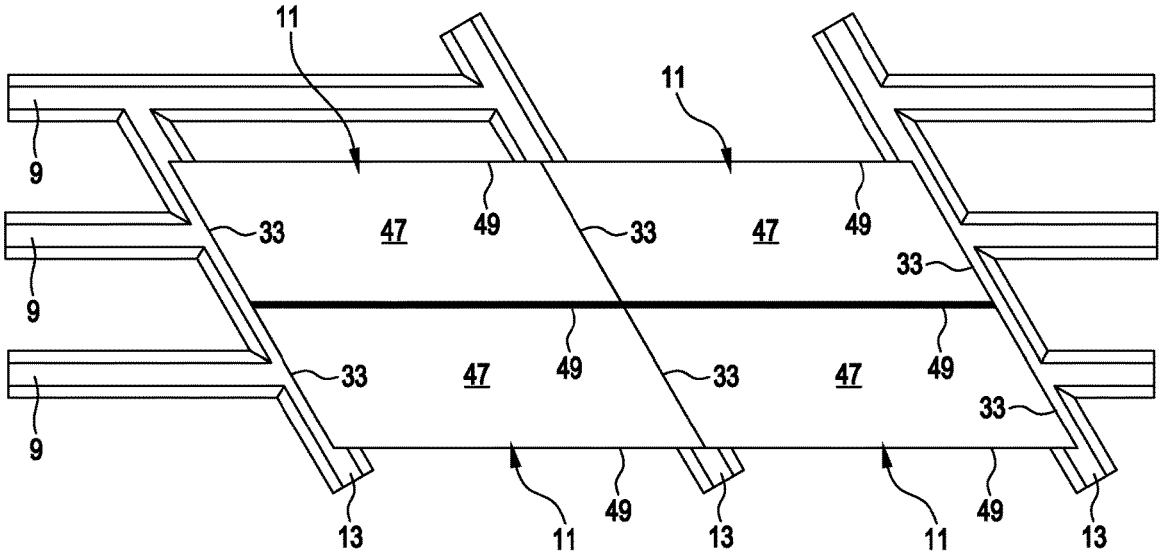

FIGS. 10B and 10F show upper openings 47 of the drawbells 11. These openings 47 are defined by the above-mentioned narrow rock ridges 33 and 49, i.e. minor pillar apex 33 and major pillar apex 49. The narrow rock ridges 33 and 49 define a quadrilateral opening for the drawbells 11.

It can be appreciated from the plan views of FIGS. 10B and 10F and the perspective views of FIGS. 5, 10A, and 10E (and as is also evident from the drone scans and cross-sections of FIGS. 8 and 9) that the openings 47 at the upper sections of the drawbells 11 are substantially the whole horizontal cross-sectional area at that height and the drawbells 11 reduce in cross-sectional area downwardly to the openings into the drawbell drives. The internal profile of the drawbells 11 is illustrated by the contour lines in each of the drawbells 11 shown in FIG. 10C.

FIGS. 11A to 11F is the same sequence of drawings shown in FIGS. 10A to 10F that show another embodiment of an arrangement of drawbells in accordance with the invention.

The same reference numerals are used in the FIGS. 10 and 11 drawing sequences to describe the same structural features.

The difference between the arrangements shown in FIGS. 10 and 11 is explained below:

(a) In the layout shown in FIG. 11, the narrow rock ridges 33 and 49 that define the upper openings 47 of the drawbells 11 are aligned with the directions of the extraction drives 13 and the drawbell drives 11, respectively. Specifically, the narrow rock ridges 33 shown in the Figures, with drawbells 11 on opposite sides of an extraction drive 13, are spaced above a centreline of the extraction drive 13. In particular, see FIGS. 11B, 11C, and 11F.

(b) In the layout shown in FIG. 10, the narrow rock ridges 33 and 49 that define the upper openings 47 of the drawbells 11 are arranged differently. Specifically, the narrow rock ridges 33 shown in the Figures, with drawbells 11 on opposite sides of an extraction drive 13, are spaced above and extend transverse rather than parallel to that extraction drive 13. In particular, see FIGS. 10B, 10C, and 10F. This is a staggered arrangement of drawbells 11, as can best be seen in FIGS. 10B, 10C, and 10F.

Proof of Concept Trial

The proof of concept trial at the Telfer mine of the applicant is described further below.

Based on the positive results of the Telfer mine trial, the applicant is planning a further, more extensive trial at the Cadia mine of the applicant.

Key features of the Cadia mine trial are described below.

Telfer Mine Trial:

The proof of concept Telfer mine trial was carried out on a confidential basis and commenced during January 2019 on a confidential basis.

The trial scope consisted of drilling and blasting four drawbells 11 (see FIG. 3 for a single drawbell 11 and FIGS. 5 and 6 for the arrangement of four drawbells 11 and other Figures described above) having selected dimensions and profile for single pass cave establishment.

The major objectives of the trial were to achieve a minimum height and to create connections across the major and minor apices of the pillars between the drawbells 11.

The key metrics of the trial were:

1. Safely execute the single pass cave establishment method with four drawbells 11.
2. Establish functional drawbells 11 and draw points and define strong pillars 37 comparable in size to those of the Cadia East block cave.
3. Achieve the minimum height and complete undercut connectivity across the four drawbells 11.
4. Minimise overbreak and pillar damage.
5. Identify technology implementation road blocks and improvement opportunities.

Telfer Mine Overview

The Telfer mine of the applicant is located in the Great Sandy Desert approximately 400 km east-south-east of Port Hedland, and 1,300 km north-east of Perth, WA.

The underground mine is emplaced in the Malu Formation. A large regional fault (Graben Fault) exists in the eastern flank of the main orebody, which is intersected by mine development.

Reef and shear units cut the entire mine strati-graphical sequence generating frequent and pervasive jointing decreasing the overall rock mass strength making it amenable to caving.

Intact rock strength is generally very high (greater than 200 MPa), except for the major ore units (around 80 MPa), with RMR values ranging from 50 to 60.

The Telfer underground operation consists of three separate and distinct mining areas.

The upper mine (M-Reefs) is focused on narrow vein reef extraction utilising long hole retreat stoping.

The lower mine is made up of a mature sub level cave (SLC) operation and the Western Flanks open stoping area.

Mining and maintenance activities are carried out by a mining contractor, with the applicant providing technical services and management oversight.

Currently mining is occurring to over 1,000 m below surface with shaft hoisting utilised to transport ore material from the lower mine.

Ore from the upper mine is trucked to the surface for transportation to the processing plant.

The current mine plan has the lower mine producing ~2.9 Mtpa as the active footprint of the SLC reduces and the Western Flanks moves towards remnant mining activities (Kilkenny et al, 2019).

Telfer Mine Trial—Drawbell Design

The design brief for the drawbells 11 and therefore drill and blast consisted of:

Positioning the trial drawbells 11 on an El Teniente layout of spacings between extraction drives 13 and drawbell drives 9—see FIGS. 5, 9A and 9C for the layout;

Retaining existing pillar dimensions used of the Cadia East block cave;

Using existing mining equipment available at Telfer; and

Operating the trial with a robust and repeatable design.

In conjunction with the above, a decision was made to not apply current novel blasting technologies to the Telfer scope and the rely on conventional blasting technologies. There were two main reasons for this decision, namely: regulatory restriction relating to pre-charging and also demonstrating that the success could be achieved using conventional technology.

The aim was to reduce complexity and identify improvement opportunities.

The decision to use existing equipment, primarily production drill rigs (conventional top hammer), impacted the final design to an extent. Due to the expected impact of drill deviation at hole lengths greater than 30 m and emulsion retention issues in long up holes, a decision was made to use 89 mm diameter holes instead of the 76 mm diameter holes used at Cadia East in drawbell development and to limit hole lengths to a maximum of 34 m. This influenced blast design and therefore the size and geometry of the resultant Telfer trial drawbells 11.

The embodiment of a drawbell 11 of the invention shown in FIG. 3 is the trial drawbell design.

With reference to the perspective view of FIG. 3, at its highest point $H_1$, the trial drawbell 11 was 38 m high (measured from the floor of the drawbell drive) and 32.5 m (measured from the base, i.e. The roof, of the drawbell drive) and has a total volume of 12,220 $m^3$. The volume is comprised of two parts; the drawbell cone (i.e. the throat section 15 and the tapered section 19) is ~5,700 $m^3$, while the undercut region (i.e. the undercut section 25) is ~6,500 $m^3$. The height $H_3$ of the drawbell cone is 27.5 m high and the height $H_2$ of the undercut region is 10.5 m.

Figure 4A:
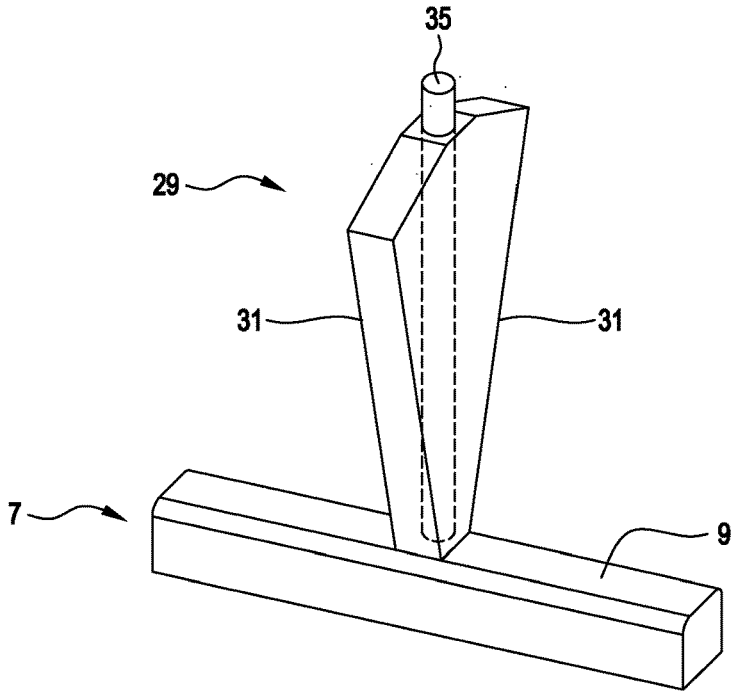
FIG. 4A is a diagrammatic perspective view and FIG. 4B is a side view of the drawbell profile shown in FIG. 3 that illustrates an embodiment of a multiple drill/blast sequence for forming the drawbell in accordance with the invention, as tested in the Telfer mine trial.
Figure 4B:
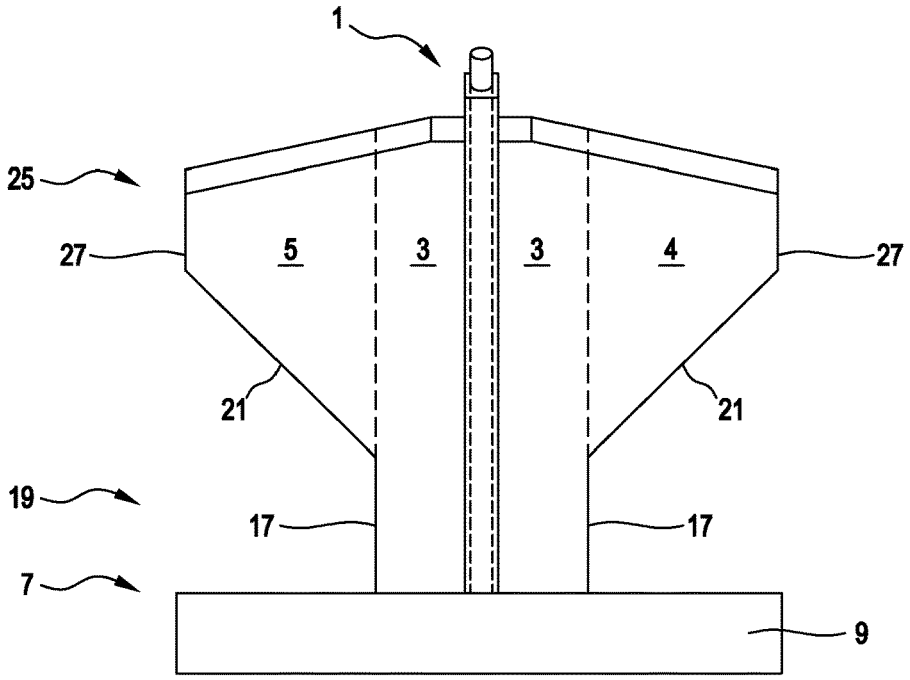

FIG. 4A is a perspective view and FIG. 4B is a side view of the drawbell profile shown in FIG. 3 that illustrates an embodiment of a multiple drill/blast sequence for forming the drawbell in accordance with the invention, as tested in the Telfer mine trial.

With reference to FIGS. 4*a* and 4*b*, each Telfer mine trial drawbell 11 was formed by forming 5 separate sections 1-5.

Section 1 was formed by drilling an uphole raise (box-hole) 35 in the centre of the drawbell drive 9. The uphole raise 35 provided initial relief for the surrounding rock mass. Section 1 was completed by drilling holes around the uphole raise 35 and charging explosives into the holes and initiating the explosives.

The result was the tapered slot 29 of uniform length along the drawbell drive 9—see FIG. 4*a*.

Thereafter, drawbell sections 2, 3, 4, and 5 were drilled in full and all holes were surveyed before charging commenced. The drawbell was then opened in five separate blast events, beginning with the section 1 as described above and subsequently with sections 2, 3, 4, and 5.

Section 1 provided a void for firing a section 2 of the drawbell 11, and sections 1 and 2 provided a void for forming sections 3, and so on.

Location and Layout

FIGS. 5 and 6 and FIGS. 10A to 10F show the Telfer trial layout, noting the above description of the drawbells 11, the drawbell drives 9, and the extraction drives 13.

The trial drawbell layout followed an El Teniente layout of 34 m×20 m, with the drawbell drives 9 being at an angle of approximately 60° to the extraction drives 13.

The trial was carried out in Telfer's M-Reefs mining area.

Suitability criteria for the trial location included minimal disruption to operations, minimal required development, quick access to multiple headings, and safe distance from critical infrastructure and the base of the active Main Dome open pit operation (see FIG. 5*a*).

Available drill hole data together with conditions observed in nearby excavations indicated appropriate quality rock mass with localised poorer conditions in the Reef that intersects the designed drawbells.

A stability analysis of the final opened shape was performed concluding that the arched back would remain stable after the trial was completed.

The total lateral development scope comprised of 420 m including stockpiles and a truck loading bay (see FIG. 5*b*). The extraction drive profile was 5 m wide×5 m high. Drawbell slot drilling required a central stripping of the drawbell drive to 6.3 m wide for a distance of 6 m.

Given that the geotechnical conditions of the trial location allowed for large profiles, a 6.3 m wide×5.5 m high profile was applied to the entire drawbell drive to avoid stripping and provide enough height for the uphole raise machine. Materials handling was via conventional loader and truck methodology, with two dedicated stockpiles being established. All material was trucked to a surface stockpile via the main decline.

Overall Sequence and Geotechnical Monitoring

During the design stage a comprehensive geotechnical review was conducted focusing on the stability of the single pass cave establishment method excavation, both during construction and at completion.

The drawbell opening sequence for each drawbell 11 was guided by both geotechnical and operational considerations.

Figure 6:
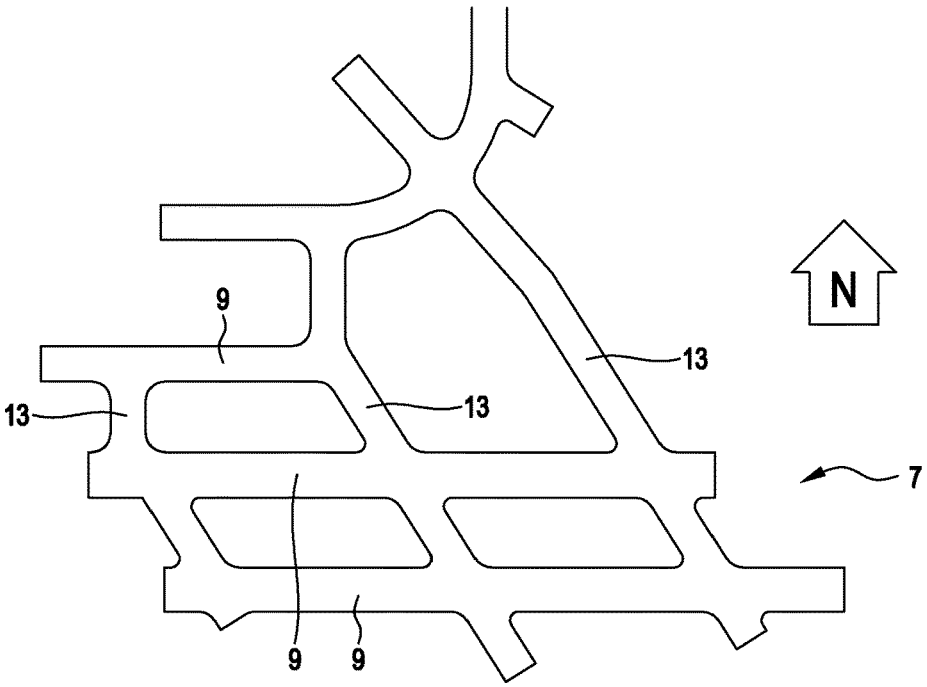
FIG. 6 is a plan view of the planned layout of the extraction and drawbell drives for the Telfer mine trial.

The main drivers were:

- Open end-to-end drawbells 11 first in order to delay the wider span being opened, and to simulate the likely sequence in a production application of single pass cave establishment method
- Open south drawbells 11 before north drawbells 11 in order to retreat towards the access—see the arrow indicating north in FIG. 6.
- Minimise physical interaction (thus improving safety) between activities to enable continuous drilling once charging and blasting activities commenced.

A geotechnical monitoring program was installed to proactively assess the condition of critical pillars during and after the trial. This included the following:

- Major apex pillar monitoring—qualitative blast hole camera surveys and smart cables were installed in the major apex pillars prior to firing.
- Crown Pillar monitoring—two 130 m long diamond drill holes were drilled from the I30 Decline to assess for crown pillar failure. One was monitored using Multi Point Borehole Extensometer (MPBX) cables while the other was left open to complete borehole camera surveys as required.

Project Execution

Figure 7:
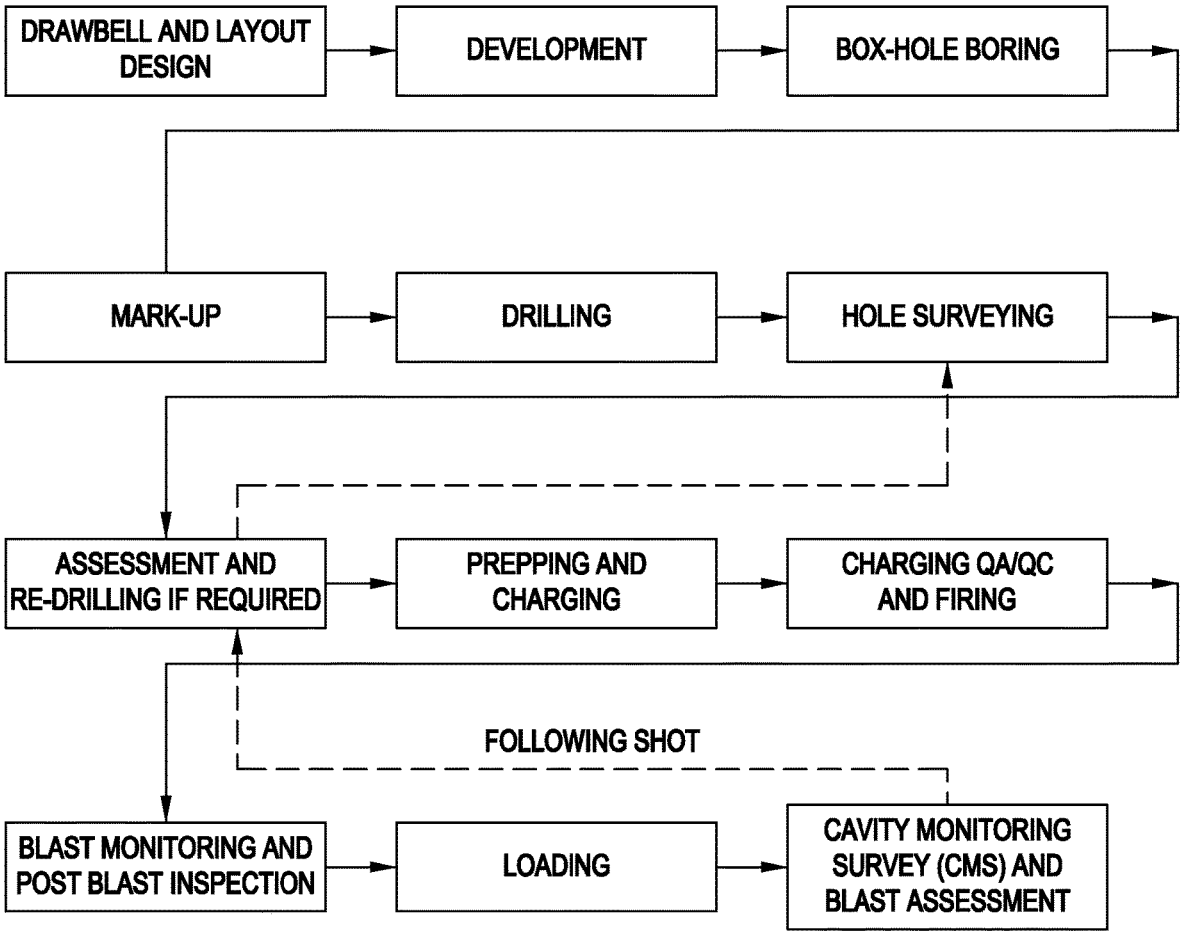
FIG. 7 is a flowsheet of the single pass cave establishment implementation methodology for the Telfer mine trial.

FIG. 7 shows the single pass cave establishment implementation methodology for the Telfer trial.

The project was integrated into the existing Telfer mine systems and forecasts.

In conjunction with the Telfer underground technical services, operations and geotechnical teams, members of the single pass cave establishment method project team were dedicated to managing and coordinating various components of the trial. This was to ensure; a high level of safety was maintained, QA/QC was completed, due process was followed, and key data was collected.

As a summary (as illustrated in FIG. 7 and outlined over the subsequent points), the Telfer mine trial execution followed the following sequence:

- Development mining activities were carried out by the incumbent mining contractor utilising twin boom development drills. Ground support varied depending on drive profile, however at a minimum Fibrecrete® and mesh were installed with bolts of dynamic capacity.
- A specialist raise boring contractor was mobilised to site to execute a scope of four (4) uphole raises. These were drilled in series after development was completed to allow concurrent activities in the footprint. Raise as-built shapes and bolt positions were picked-up to adjust the slot holes collars if required.
- Mark-up procedure included laser lines off-sets and hole collaring mark-up to minimise collaring error Drilling was executed by the mining contractor using a Sandvik DL421 rig with Minnovare's Production Optimiser® (Azi Aligner) tool with the objective to minimise collar alignment error.
- A specialist provider (DHS Australia) was mobilised to conduct detailed drill hole surveys. A survey was performed for every hole using an IsGyro® mounted on heavy duty poly pipe. Surveying was required to understand the deviation and impact it may have, as well as allowing as-drilled holes to be assessed for any remedial re-drills for each shot. Re-drilled holes were also surveyed and assessed before issuing the charge and timing plan for the shot.
- After hole preparation, blast holes were charged with Dyno Nobel Titan 7000SX® bulk emulsion and initiated with SmartShot® electronic detonators. A combination of red caps, MTi's Blastbags® and Blastballs® were used for charge retention and to minimise slumping. Self-inflating Blastbags® were cooled on ice to slow down the inflation process and reach up to 15 m up the hole where required. Inflatable Blastballs® and Blastbags® were used to reach higher collaring heights as they could be inflated after being positioned inside the hole.

Charging and timing QA/QC was conducted by the technical team of the applicant and Dyno Nobel supervisors prior to firing each shot in order to detect deviation to the plan and amend as appropriate. Checks included detonator timing, response and leakage, explosive retention (observable slumping) and actual charge weights.

During the blast events, three uniaxial blast monitors were installed in the footprint to measure vibrations caused by the blast to record the overall behaviour After the blast and prior to loading, visual inspections were conducted in order to assess blast ejection, fragmentation as well as the level of damage inflicted on drawbells and pillars.

All material movement was carried out using conventional truck and loader practices, utilising the contractor's Sandvik LH621 loaders and TH663 (60t) articulated trucks. A dedicated waste pad was set up near the main portal to minimise tram distance Shots were emptied, and the cavity surveyed (CMS) to assess blast outcome. Drone surveying (LiDAR) was performed to scan the as-built shapes of the shots with low visibility for the conventional CMS.

Due to the issues caused by hole deviation and in hole explosive retention, for each fired shot, all data was collected, analysed and, if necessary, specific instructions or re-designs were issued before proceeding to fire the next shot. This was to ensure learning and continuous improvements were being applied.

Telfer Trial Results and Key Learnings

FIGS. 8 and 9 are images that illustrate drone scans and cross-sectional views of drawbells 11 formed in the Telfer mine trial.

As shown in FIG. 9, full connectivity was achieved between the drawbells 11, both across the major and minor apex pillars. Undercut planned height was also achieved across all four drawbells 11. Most importantly, this was all completed without a single safety incident.

The measured overall underbreak was 5 percent, mainly concentrated in the drawbell backs, however this did not compromise the full achievement of the planned undercut height and drawbell connectivity.

Several key learnings are evident on completion of the Telfer trial. In order of execution sequence these, along with remedial decisions are:

Development quality:

Drawbell drives 9 were mined with an inconsistent profile including excessive overbreak in some areas. This caused difficulty in collaring and drilling holes as per design. Blast damage inflicted during development contributes to brow overbreak and premature erosion. Smooth blasting techniques and stringent quality control shall be incorporated in the next trial to be conducted at Cadia East mine.

Drilling accuracy:

Based on the comprehensive survey data set, overall average toe deviation was approximately 3% (~1.0 m for a typical 30 m hole), with some toes deviating up to 7.7%. Compounding this, a high degree of variability in the deviation direction caused several holes to cross over rings or leave large gaps. Remedial actions including re-drilling (overall 6% re-drilling rate) and hole grouting were required to improve the explosive distribution within the blast. Enhanced drilling accuracy is required for the following trial and further single pass cave establishment method implementation. This can be achieved by using in the hole (ITH) or Wassara style drilling equipment.

Drawbell Overbreak:

Some overbreak was observed at the intermediate and final brows and to a lesser degree within the pillars. This has been attributed to the structural fabric in the trial area in conjunction with the blasting damage from development, as well as explosive retention techniques.

Pillar Integrity:

The decision to not use a solid stemming product for the pillar defining blast holes meant that the pillars suffered varying degrees of blast damage. This issue will be addressed in the next trial.

Considerations for the Cadia East Trial

Building on the proof of concept and lessons learned from the Telfer trial, the Cadia East trial will test further the single pass cave establishment method of the invention, with a greater focus on potential application in a real-world production environment.

The trial will assess and if viable include the following;

The application of smooth blasting techniques for the drawbell drives and extraction level.

A refined drill and blast drawbell design aimed at minimising damage to drawbells and pillars.

The use of more accurate drilling equipment, such as in the hole (ITH) drilling rigs to achieve higher drawbells.

Wireless electronic detonators.

Improved in hole explosive retention techniques.

Pillar integrity monitoring designed to deliver the key data required to model the Cadia East rock mass response to a future large-scale implementation of the method.

Alternative shape and connectivity confirmation methods such as C-ALS®, TDR (Time Domain Reflectrometry) and Smart Markers to verify critical connectivity and successful blast after every shot without the need to empty the drawbell.

CONCLUSIONS

The single pass cave establishment method of the invention (with no undercut level) is a significant step change for the underground mass mining industry.

It provides an opportunity for a safer working environment while reducing cave establishment cost and duration via opening drawbells and undercutting the orebody from a single level, eliminating the undercut level.

Successful results from the trial at Telfer were achieved, with complete undercut and connectivity achieved across the four drawbell footprint.

As far as the applicant is aware, this is the first time that a series of drawbells and undercut have been established from a single level with no aid from a void above (undercut or other development). The drawbells, pillars and undercut height were developed to design specification.

This is a significant step forward in drawbell establishment for the industry.

Experience and lessons learned from the first trial are being transferred to the planning for the second trial in Cadia East. This trial will address key issues encountered; i.e. development quality, drilling accuracy and brow and pillar protection.

Many modifications may be made to the embodiments of the invention described in relation to the Figures without departing from the spirit and scope of the invention.

By way of example, whilst the Figures depict a number of particular types of vehicles, the invention is not limited to these vehicles.

In addition, whilst the Figures show a particular layout of the extraction level 9 and hydraulic fracturing and blast fracturing patterns, the invention is not limited to patterns.

The invention claimed is:

1. A drawbell defining a volume extending between and interconnecting a caved volume and an extraction level of a block cave, so that in a mining operation caved rocks can flow downwardly from the caved volume to the extraction level, whereby the drawbell comprises:

(a) a drawbell height of at least 25 meters measured from a back of the extraction level to a highest point of the drawbell, and (b) the following profile in a direction of a drawbell drive in the extraction level, i.e. when viewed in a direction perpendicular to the direction of the drawbell drive:

(i) a throat section having opposed parallel side walls extending upwardly, typically perpendicular, from the extraction level, (ii) a tapered section above the throat section, the tapered section having side walls extending outwardly from upper ends of the side walls of the throat section, and (iii) an undercut section above the tapered section, the undercut section having opposed parallel side walls extending upwardly from upper ends of the side walls of the tapered section and typically perpendicular to the extraction level.

2. The drawbell according to claim 1, the throat, tapered and undercut sections of the profile of the drawbell include a front wall and a rear wall extending upwardly and outwardly in relation to each other from the extraction level.

3. The drawbell according to claim 1, wherein the drawbell void volume is at least 9000 cubic meters.

4. The drawbell according claim 1, comprising (a) an upper region in the form of the undercut section and (b) a lower region in the form of the throat and the tapered sections.

5. The drawbell according claim 1, wherein the drawbell height is at least 30 meters measured from a back of the extraction level to a highest point of the drawbell.

6. The drawbell according to claim 1, wherein the height of the throat section of the drawbell is at least 10 meters.

7. The drawbell according to claim 1, wherein the height of the tapered section of the drawbell is at least 16 meters.

8. The drawbell according to claim 1, wherein the height of the undercut section of the drawbell is at least 7 meters.

9. The drawbell according claim 1, wherein a spacing between the side walls of the throat section of the drawbell, is at least 14 meters.

10. The drawbell according to claim 1, wherein a spacing between the side walls of the undercut section of the drawbell is at least 40 meters.

* * * * *